US007500735B2

(12) United States Patent
Komatsu

(10) Patent No.: US 7,500,735 B2
(45) Date of Patent: Mar. 10, 2009

(54) LIQUID DROPLET EJECTING APPARATUS AND LIQUID DROPLET EJECTING METHOD

(75) Inventor: Katsuaki Komatsu, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 321 days.

(21) Appl. No.: 11/363,011

(22) Filed: Feb. 27, 2006

(65) Prior Publication Data

US 2006/0197806 A1 Sep. 7, 2006

(30) Foreign Application Priority Data

Mar. 3, 2005 (JP) ..... 2005-058646
Nov. 24, 2005 (JP) ..... 2005-338412

(51) Int. Cl.
*B41J 2/045* (2006.01)

(52) U.S. Cl. ..... 347/68; 347/57

(58) Field of Classification Search ..... 347/9, 347/10, 11, 20, 40, 42, 54, 57–59, 68, 70–72
See application file for complete search history.

(56) References Cited

U.S. PATENT DOCUMENTS 6,811,238 B2 * 11/2004 Shingyohuchi ..... 347/11

FOREIGN PATENT DOCUMENTS

JP 10-250064 9/1998

* cited by examiner

*Primary Examiner*—Juanita D Stephens
(74) *Attorney, Agent, or Firm*—Lucas & Mercanti, LLP

(57) ABSTRACT

An apparatus for ejecting liquid droplets, including: ejecting head main body having a plurality of nozzle rows; a pressure generation chamber; a pressurization section for giving pressure to the pressure generation chamber; and plural drive circuits corresponding to the nozzle rows, each drive circuit including: a first storage section for storing the ejection data corresponding to a nozzle row; a first latch section for storing the ejection data from the first storage section; a second latch section for storing the ejection data from the first latch section; and a drive section for driving the pressurization section based on the ejection data stored the second latch section; and a control section, which ensures that a timing for storing the ejecting data into the first latch section is synchronized among the nozzle rows, and a timing for storing the ejecting data into the second latch section can be adjusted independently.

14 Claims, 14 Drawing Sheets

FIG. 7

| STB - n | STB - n | STB - n | IMAGE DATA | DRIVE WAVEFORM PATTERN DATA |
|---|---|---|---|---|
| n = 1 | n = 2 | n = 3 | (0, 0, 0) | (1, 1, 1, 1, 0, 1, 1, 0) |
| n = 1 | n = 2 | n = 3 | (0, 0, 1) | (1, 1, 1, 1, 2, 1, 1, 0) |
| n = 1 | n = 2 | n = 3 | (0, 1, 0) | (1, 1, 1, 2, 2, 1, 1, 0) |
| n = 1 | n = 2 | n = 3 | (0, 1, 1) | (1, 1, 1, 2, 2, 2, 1, 0) |
| n = 1 | n = 2 | n = 3 | (1, 0, 0) | (1, 1, 2, 2, 2, 2, 1, 0) |
| n = 1 | n = 2 | n = 3 | (1, 0, 1) | (1, 1, 2, 2, 2, 2, 2, 0) |
| n = 1 | n = 2 | n = 3 | (1, 1, 0) | (1, 2, 2, 2, 2, 2, 2, 0) |
| n = 1 | n = 2 | n = 3 | (1, 1, 1) | (2, 2, 2, 2, 2, 2, 2, 0) |
| n = 2, 3 | n = 1, 3 | n = 1, 2 | (H, I, J) | (1, 1, 1, 1, 1, 1, 1, 0) |
| out - D | | | NO DATA | (1, 1, 1, 1, 1, 1, 1, 0) |

EACH OF H, I, J IS AN ARBITRARY NUMBER OF 0 OR 1

LIQUID DROPLET EJECTING APPARATUS AND LIQUID DROPLET EJECTING METHOD

This application is based on Japanese Patent Application Nos. 2005-058646 filed on Mar. 3, 2005, and 2005-338412 filed on Nov. 24, 2005 in Japanese Patent Office, the entire content of which is hereby incorporated by reference.

BACKGROUND OF THE INVENTION

1. Field of the Invention

The present invention relates to a liquid droplet ejecting apparatus and a liquid droplet ejecting method.

2. Background Technology

In the liquid droplet ejecting head for ejecting liquid droplets from nozzles such as an inkjet recording head (hereinafter referred to as "recording head" in some cases) for recording an image using minute ink particles, pressure is given into the pressure generation chamber so that ink particles are ejected from the nozzle, whereby ink particles are applied onto a recording medium such as recording paper.

There are a great variety of liquid droplet ejecting apparatuses provided with a plurality of nozzle rows. The following describes the drive circuit of the recording head disclosed in the Patent Document 1, wherein ink particles are ejected while a recording head containing a row of nozzles for four colors (Y, M, C and K) is moved for scanning in the main scanning direction of the carriage.

The head driver is made of ICs. One head driver is arranged for each of the four colors (Y, M, C and K). Each driver head contains a shift register, a latch, a digital comparator, a selection gate, a level shifter, a driver and a counter. Each head driver is connected to a 128-bit×3 shift register, and the image data from the line memory is stored in this shift register on a temporary basis.

The shift register has a storage capacity for storing the image data having the number of pixels equivalent to one-time ejection from the nozzle head, and is used to memorize the 128-pixel image data arranged in the sub-scanning direction. When the carriage has reached the position suited for recording, the control circuit outputs a LOAD signal. Upon receipt of the LOAD signal, the latch latches the image data outputted in parallel from the shift register.

The yellow (Y) image data is sent to the head driver from the line memory using a 3-bit data signal line. The yellow 128-pixel image data having been sent to the head driver is subjected to parallel processing, and recording is implemented by the head Y.

Similarly, the magenta (M) image data is sent from the line memory to the head driver, and recording is implemented by the head M. The cyan (C) image data is sent from the line memory to the head driver, and recording is implemented by the head C. The black (K) image data is sent from the line memory to the head driver, and recording is implemented by the head K.

The carriage starts one reciprocating motion based on the information obtained by encoder detection. When it has reached a predetermined position during its travel in the outward direction, the AND gate allows the TRGIN signal for starting ink ejection to be sent to the head driver through the control circuit. Upon receipt of the aforementioned TRGIN signal, the head driver sends the drive signal and ink is ejected from the head.

[Patent Document 1] Japanese Non-examined Patent Application Publication H10-250064

In recent years, there has been a drastic increase in the amount of data to be processed, due to the increasing number of gradations in recording data, higher density in the recording head and an increasing number of nozzles. This has consumed a lot of time for data transmission.

In the drive circuit corresponding to one nozzle row as in the conventional drive circuit, the position of ink arrival is adjusted at a pitch finer than the pixel pitch for each nozzle row, if there is only one latch. Accordingly, when different timing is used for ejection from each nozzle row, timing for data transmission to the shift register must be changed for each nozzle row.

This requires that the trigger for sending the data to the shift register corresponding to each nozzle row should be produced for each nozzle, with the result that complicated trigger control has to be provided. Especially when there are Y, M, C and K nozzle rows are provided, and a plurality of nozzle rows are provided for each color, the structure will become more complicated.

The timing for transmitting data to the shift register is the same for each row. This makes it essential to increase the data transmission speed or decrease the recording speed more than necessary.

The object of the present invention is to solve the aforementioned problems and to provide a liquid droplet ejecting apparatus and liquid droplet ejecting method capable of effective trigger processing for data transmission to the shift register, without having to overly increase the data transmission speed or decrease the recording speed, and further capable of adjusting the position for arrival of liquid droplets for each nozzle row at a pitch finer than the pixel pitch.

SUMMARY OF THE INVENTION

The object of the present invention can be achieved by the following structure:

(1) An apparatus for ejecting liquid droplets onto a recording medium, including: a liquid droplet ejecting head main body which has: a plurality of nozzle rows for ejecting the liquid droplets; a pressure generation chamber communicating with a nozzle in the plurality of nozzle rows; a pressurization section, driven based on ejecting data, for giving pressure to the pressure generation chamber so that the liquid droplets are ejected from nozzles; and a plurality of drive circuits corresponding to the plurality of nozzle rows, each of the plurality of drive circuits comprising: a first storage section for storing the ejection data corresponding to a nozzle row in the plurality of nozzle rows; a first latch section for storing the ejection data outputted from the first storage section; a second latch section for storing the ejection data outputted from the first latch section; and a drive section for driving the pressurization section based on the ejection data stored the second latch section; and a control section, wherein the control section ensures that a timing for storing the ejecting data outputted from the first storage section into the first latch section is synchronized among the plurality of nozzle rows, and a timing for storing the ejecting data outputted from the first latch section into the second latch section is capable to be adjusted independently among a plurality of nozzle rows.

BRIEF DESCRIPTION OF THE DRAWINGS

FIG. 7 is a diagram showing a table defining the relationship between the image data and drive waveform pattern data corresponding to a plurality of drive waveforms for driving the pressurization section;

DETAILED DESCRIPTION OF THE PREFERRED EMBODIMENTS

Figure 1:
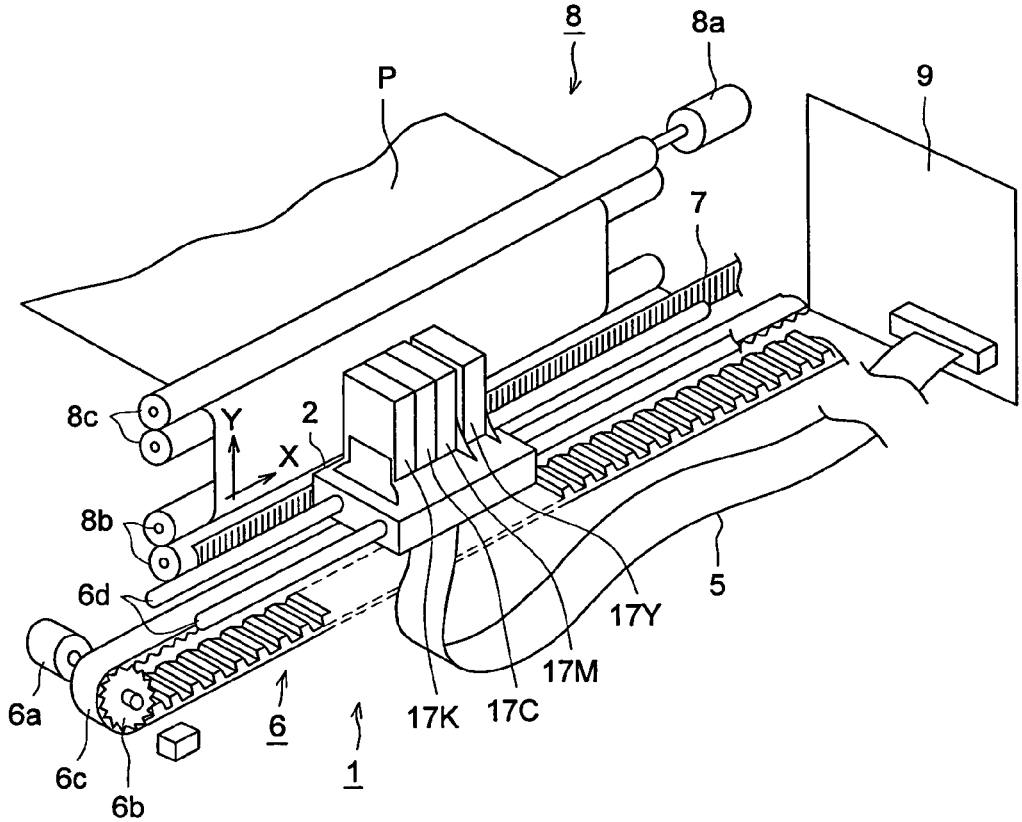
FIG. 1 is a perspective view showing the major components of a serial type inkjet printer.

The aforementioned object of the present invention can be achieved further by the following structures:

(2) The liquid droplet ejecting apparatus described in the Structure (1), wherein in each of the plurality of drive circuits, a first trigger signal for specifying the timing for storing the ejection data outputted from the first storage section into the first latch section, and a second trigger signal for specifying the timing for storing the ejection data outputted from the first latch section into the second latch section are a common trigger signal.

(3) The liquid droplet ejecting apparatus described in the Structure (2), wherein the common trigger signal is a pulse signal having two edges of a rising edge and a falling edge, wherein a first edge of the two edges is the first trigger signal and a second edge of the two edges is the second trigger signal.

(4) The liquid droplet ejecting apparatus described in any of the Structures (1) through (3) wherein, of a plurality of nozzle rows, those for ejecting the same color liquid droplets are formed into one nozzle plate.

(5) The liquid droplet ejecting apparatus described in the Structure (4) wherein nozzle rows for ejecting the liquid droplets of the same color are arranged in the main scanning direction for the recording medium, and the nozzles of each of the nozzle rows are arranged in displaced positions so as to interpolate one another, in such a way that a predetermined line is formed on the recording medium by the liquid droplets of the same color ejected from each of the nozzles of the aforementioned nozzle rows.

(6) A method for ejecting liquid droplets from nozzles onto a recording medium with using: a liquid droplet ejecting head main body which including a plurality of nozzle rows for ejecting liquid droplets, a pressure generation chamber communicating with a nozzle in the plurality of nozzle rows, and a pressurization section, driven based on ejecting data, for giving pressure to the pressure generation chamber so that liquid droplets are ejected from the nozzles; and a plurality of drive circuits corresponding to the plurality of nozzle rows, the method comprising:

storing the ejection data, corresponding to the plurality of nozzle rows stored in a first storage section of the plurality of drive circuits, into a first latch section at a timing for synchronizing among the plurality of nozzle rows;

storing the ejection data stored in the first latch section into a second latch section at a timing independently set among the plurality of nozzle rows; and ejecting liquid droplets from the plurality of nozzle rows by driving the pressurization section at the timing independently set among a plurality of nozzle rows, based on the ejection data stored in the second latch section.

The inventors of the present invention have been led to the present invention by the following findings: Effective trigger processing for data transmission can be ensured without having to overly increase the data transmission speed or decrease the recording speed, and the position for arrival of liquid droplets for each nozzle row can be adjusted at a pitch finer than the pixel pitch, if provided with a plurality of nozzle rows for ejecting liquid droplets; a pressure generation chamber communicating with the nozzles constituting the aforementioned nozzle rows; a liquid droplet head main body provided with a pressurization section, driven based on the ejection data, for giving pressure to the pressure generation chamber so that liquid droplets are ejected from nozzles; and a plurality of drive circuits corresponding to the aforementioned plurality of nozzle tows. In this case, each of the drive circuits includes a first storage section for storing the ejection data corresponding to nozzle rows; a first latch section for storing the ejection data outputted from the first storage section; a second latch section for storing the ejection data outputted from the first latch section; and a drive section for driving the pressurization section based on the ejection data stored the second latch section. Further, a control section is also included to ensure that the timing for storing the ejection data of the first storage section into the first latch section is adjusted for synchronization among a plurality of nozzle rows, and the timing for storing the ejection data of the first latch section into the second latch section can be adjusted independently among a plurality of nozzle rows.

The following describes the embodiments of the present invention, without the present invention being restricted thereto:

The main body of the liquid droplet ejecting head of the present invention can be applied to any type of the liquid droplet ejecting head if it is provided with a plurality of nozzle rows for ejecting liquid droplets; a pressure generation chamber communicating with the nozzles constituting the aforementioned nozzle rows; a pressurization section, driven based on the ejection data, for giving pressure to the pressure generation chamber so that liquid droplets are ejected from nozzles. Any type of liquid can be filled in the pressure generation chamber. The following description will be made with reference to the shear mode type inkjet head main body.

In the shear mode type inkjet head main body, at least part of the pressure generation chamber is made of the piezoelectric device as a pressurization section, and ink is ejected from the nozzle by deforming this piezoelectric device.

A combination of the liquid droplet ejecting head main body and drive circuit are defined as a liquid droplet ejecting head.

An inkjet printer will be used to describe the liquid droplet ejecting apparatus using such an ink particle ejecting head.

Mechanical Arrangement of Inkjet Printer

The following describes the present invention with reference to the drawing of FIG. 1 representing the mechanical arrangement of the major components of a serial type inkjet printer 1, without the present invention being restricted thereto.

In this embodiment, reference is made to an example of a printer equipped with inkjet head main body containing a total of eight rows of nozzles for four colors (Y, M, C and K), wherein two nozzle rows are provided for each color. However, the number of the nozzles are not restricted to eight alone. Any printer can be used in the present invention if recording is made using a head main body equipped with at least two rows of nozzles. Further, the present invention is also applicable to a plurality of nozzle rows for a single color.

The arrangement of the head main body 17 and drive circuit 16 is common to the Y, M, C and K. In the following description, alphabetical subscripts showing the arrangement of each color will be omitted, and collective representation will be used in some cases.

The carriage 2 is a resin casing incorporating a head main body 17, a drive circuit 16 for four colors for driving the pressurization section of the head main body 17, and an ink cartridge (not illustrated). The drive circuit 16 housed in the carriage 2 is made of an IC, and is connected with a control board 9 by means of a flexible cable 5.

The main body 17 as the ink particle ejecting head is made of the head main bodies for four colors (Y, M, C and K). The head main body 17 of each color is provided with two nozzle rows arranged in the X direction as the main scanning direction with respect to the recording medium. The number of nozzles is 256 for each row. They are arranged in the Y direction as the sub-scanning direction. Each nozzle is provided with the drive circuit 16.

The carriage 2 makes a reciprocating motion in the main scanning direction marked by "X" in the drawing when driven by the detection roller shaft 6. The carriage drive mechanism 6*a* includes a motor 6*a*, a pulley 6*b*, a geared belt 6*c* and a guide rail 6*d*. The carriage 2 is fixed in position by the geared belt 6*c*.

When the pulley 6*b* is driven by the motor 6*a*, the carriage 2 fixed to the geared belt 6*c* is moved in the direction marked by X in the drawing. The guide rail 6*d* is made of two cylinders parallel to each other, and is designed to penetrate the through-hole of the carriage 2 to allow sliding motion of the carriage 2.

This arrangement ensures that the geared belt 6*c* is not deflected by the weight of the carriage 2, and the reciprocating motion of the carriage 2 is kept in a straight line. Reversing of the rotation of the motor 6*a* changes the direction of the movement of the carriage 2, and changing the rotation speed allows the traveling speed of the carriage 2 to be changed.

The ink cartridge incorporates an ink tank. The ink inlet of the ink tank can be opened by setting the ink cartridge to the carriage 2 and connecting it to the ink supply pipe. The inlet is closed by disconnecting them. Ink is supplied to the head main body 17.

The carriage 2 is provided with an ink cartridge installation bracket to permit mounting and dismounting of the ink cartridge storing the inks of various colors (Y, M, C and K) to be ejected.

The flexible cable 5 is a data transmission section for sending the image data as the ejection data. It is made of a flexible film on which a wiring pattern including the data signal line and power line is printed. It is used to transfer data between the drive circuit 16 and control board 9 and follows the movement of the carriage 2.

The encoder 7 is composed of a transparent resin-made film graduated at predetermined intervals. The graduation is detected by an optical sensor mounted on the carriage 2, and the traveling speed of the carriage 2 is detected.

A sheet conveyance mechanism 8 feeds the recording paper P in the sub-scanning direction marked by Y in the drawing, and is formed of a conveyance motor 8*a* and a conveyance roller pair 8*b* and 8*c*. The conveyance roller pair 8*b* and conveyance roller pair 8*c* are driven by the conveyance motor 8*a*, and are rotated by a gear train (not illustrated) at approximately the same peripheral speed, wherein the speed of the conveyance roller pair 8*c* is slightly higher.

The recording paper P is fed out of the sheet feed mechanism 8, and is sandwiched by the conveyance roller pair 8*b* rotated at a constant speed. After the direction of feed of the recording paper is changed to the sub-scanning direction by a sheet feed guide (not illustrated), the recording paper is held by the conveyance roller pair 8*c* and is fed.

The peripheral speed of the conveyance roller pair 8*c* is slightly higher than that of the conveyance roller pair 8*b*. This arrangement allows the recording paper P to pass the recording section without being loose. Further, the speed of the recording paper P moving in the sub-scanning direction is set to a constant value.

In this manner, while the recording paper P is moved in the sub-scanning direction at the constant speed, the carriage 2 is moved in the main scanning direction at the constant speed. Thus, the ink ejected from the head 17 is applied to the recording paper so that an image is recorded in a predetermined range on one side of the recording paper P.

To improve the recording speed, this printer allows ink particles to be ejected to record the image at the time of scanning in both the outward and homeward directions of the main scanning direction. (In the following description, such a recording method is called a bi-directional recording technique in some cases).

Structure of Inkjet Head Main Body

Referring to the drawing, the following describes an embodiment of the head main body in the inkjet printer of FIG. 1, without the present invention being restricted thereto.

Figure 2:
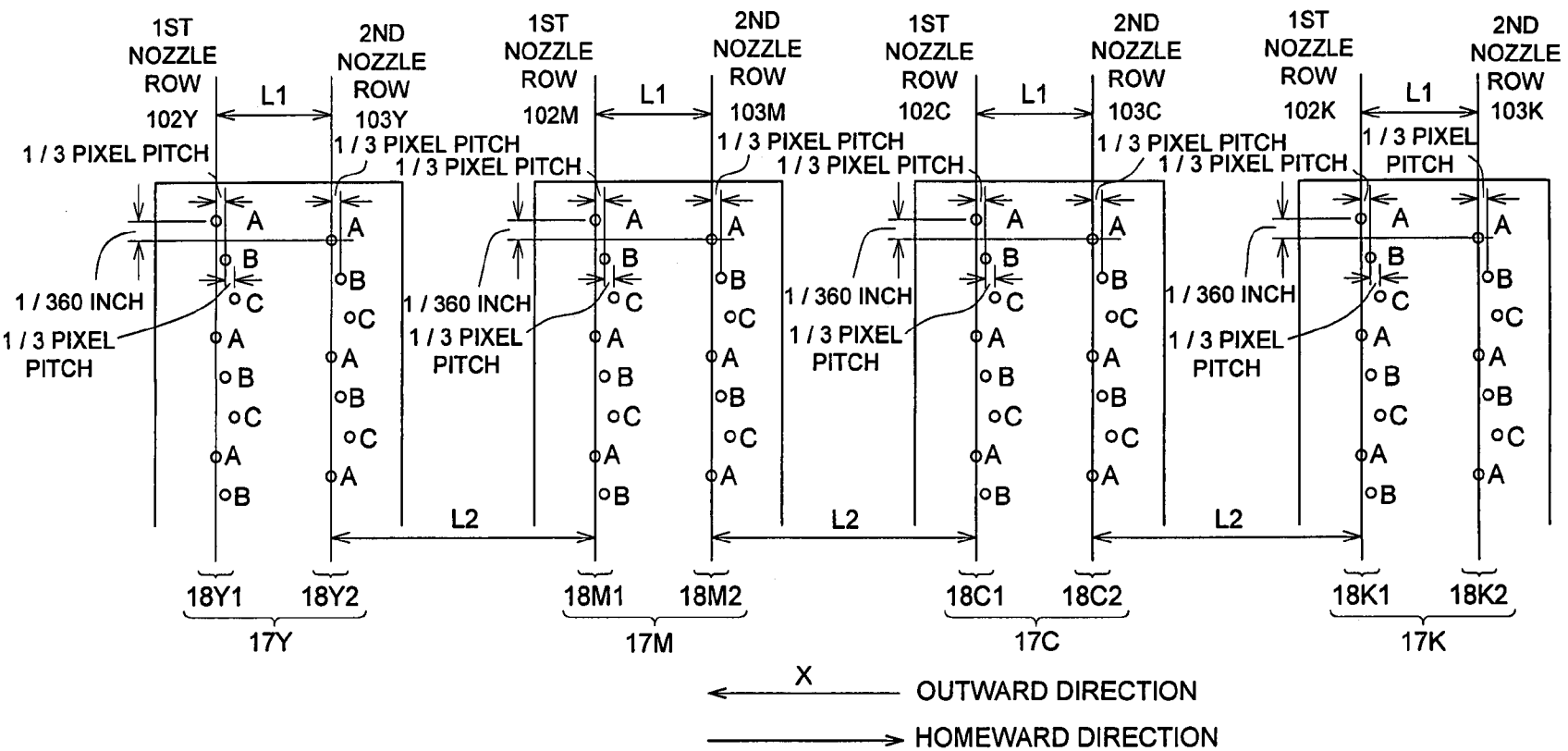
FIG. 2 is an enlarged view of the nozzle of the inkjet head.

FIG. 2 is an enlarged view of the nozzle section when the inkjet head main body 17 of FIG. 1 is viewed from the direction of the recording paper P. This drawing, 15 nozzles per color corresponding to part of the 512 nozzles per color.

The nozzle sections 17Y, 17M, 17C and 17K constituting the inkjet head main body 17 are arranged in that order in the main scanning direction X at a predetermined distance. For the inkjet head main body for each color, for example, the nozzle section 17Y has the first nozzle row 102Y of the nozzle 18Y1 and the second nozzle row 103Y of the nozzle 18Y2 in the main scanning direction X for the recording medium. To be more specific, a total of eight nozzle rows are arranged in the main scanning direction. These nozzle rows are separated by distance L1 among nozzle rows for the same color and by distance L2 for different colors. In order to ensure that ink particles ejected from these eight nozzle rows are ejected to a predetermined position and a linear image is formed in the sub-scanning direction, the timing for ink particles ejection from each nozzle row needs adjustment. When image printing is started, the succeeding nozzle row is driven in conformity to the ejection cycle determined by the main scanning speed of the recording head and the aforementioned distance, with respect to the preceding nozzle row in the main scanning direction of the head, and image printing starts predetermined cycles later. When printing is performed in both the outward and homeward directions, timing for applying drive waveform is displaced among nozzle rows on the homeward path in the order reverse to that used on the outward path. The present invention is characterized by data processing for adjustment of the ejection timing related to the ink particle ejection technique and the drive circuit structure related to data processing. The details will be described later.

When driving the shear mode type recording head provided with a plurality of pressure generation chambers separated by the partition at least partly formed of the piezoelectric material, if the partition of one pressure generation chamber performs ejection operation, the adjacent pressure generation chamber will be affected. Accordingly, drive control is provided as follows: Of a plurality of pressure generation chambers (nozzles), the pressure generation chambers (nozzles), sandwiching one or more pressure generation chambers (nozzles), being separated from each other, are collected into one group in such a way that they will be divided into M groups (where M denotes an integer) in the final phase, and ink ejection operation is carried out on a time-divided basis for each group. The present embodiment uses the so-called three cycle ejecting method wherein all the pressure generation chambers (nozzles) are divided into three groups by selection of every two chambers. Then ink ejecting operation is carried out.

In the present embodiment, each nozzle row is made up of 256 nozzles. The nozzles in each row are arranged so that adjacent nozzles are displaced by one third of the minimum pixel pitch in the main scanning direction in three nozzle cycles. In each row, drive operation is performed in three cycles of groups A, B and C at intervals of two nozzles, in conformity to the ejection cycle determined by the main scanning speed of the recording head and the displacement of one third of the minimum pixel pitch. This arrangement aligns the position of arrival of the ink particles ejected from the nozzles of groups A, B and C, and allows a line image to be formed straight in the sub-scanning direction.

As described above, the method of dividing inside the nozzle row for driving reduces the number of the pressurization sections to be driven simultaneously, and reduces the drive circuit load. It also saves the drive circuit drive capacity. Thus, use of the small-capacity drive source ensures a significant curtailment of required costs.

The nozzle pitch in the nozzle row direction in the row is 180 dpi (141 μm). Two rows are arranged in parallel, and nozzles are displaced 70.5 μm (equivalent to 360 dpi with respect to each other in the direction of the nozzle row. The nozzle density in the direction of the nozzle row is 360 dpi for all the two rows, and a total of 512 nozzle groups are formed. To be more specific, they are arranged in the form displaced in the direction of the nozzle row to ensure that the positions of nozzle rows 102 and 103 are complementary to each other so as to conform to the image grid. This arrangement allows all the pixels to be recorded in one scanning operation.

Figure 3:
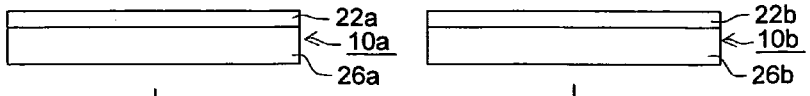
FIGS. 3(*a*) through (*g*) are schematic diagrams representing the shear mode type the inkjet head and the manufacturing process thereof.
Figure 3:
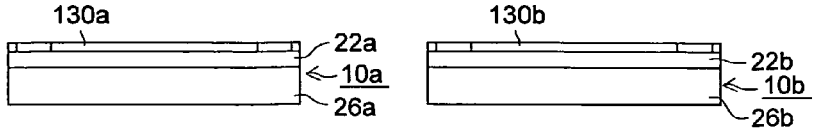
Figure 3:
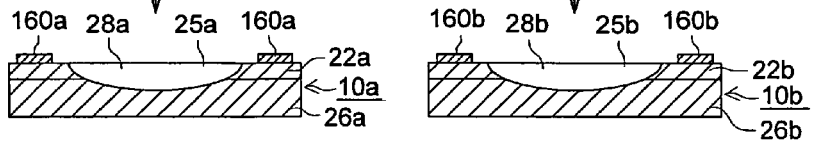
Figure 3:
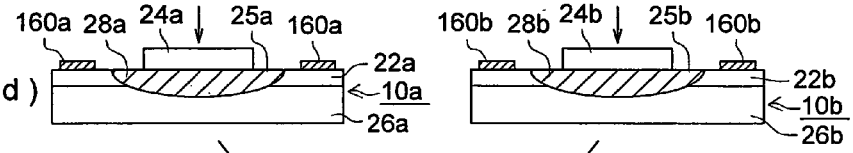
Figure 3:
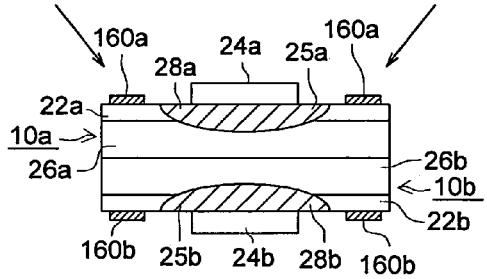
Figure 3:
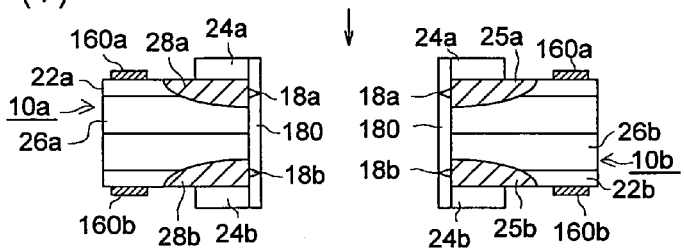
Figure 3:
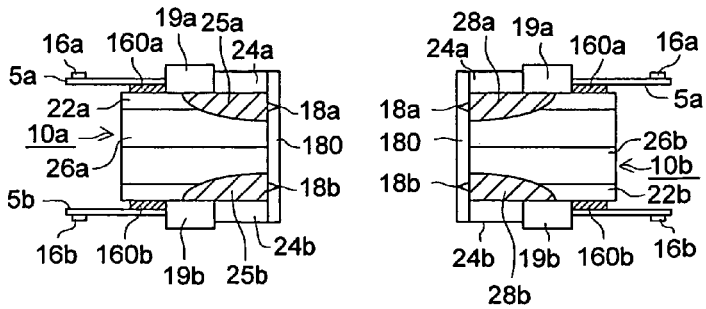

FIG. 3 is a schematic diagram representing the shear mode type inkjet head main body for one color and the manufacturing process thereof.

FIG. 3 shows the structure of the head main body 17Y. The head 17M through 17K are also arranged in the same structure.

In the first place, the first piezoelectric material substrate la and the second piezoelectric material substrate lob polarized differently with each other are prepared. The first piezoelectric material substrate 10*a* is formed of a thick substrate 26*a* and a thin substrate 22*a*. Similarly, the second piezoelectric material substrate 10*b* is also formed of a thick substrate 26*b* and a thin substrate 22*b* (FIG. 3(*a*)).

A dry film 130*a* is bonded on the thin substrate 22*a* of the first piezoelectric material substrate 10*a*, and this dry film 130*a* is subjected to exposure and development, thereby forming a mask for setting the machining position for an ink channel to be formed into a pressure generation chamber or an electrode (FIG. 3(*b*)). On the first piezoelectric material substrate 10*a*, 258 channels are formed at the position determined by the mask, using a diamond blade or the like, whereby a pressure generation chamber 28*a* is produced. This arrangement causes the adjacent pressure generation chambers to be separated by the partition of a piezoelectric material. A drive electrode 25*a* is formed on the pressure generation chamber 28*a* by aluminum vapor deposition, and a takeout electrode 160*a* connected to this drive electrode 25*a* is formed (FIG. 3(*c*)).

Here, of the 258 pressure generation chambers, two pressure generation chambers on both ends are the dummy pressure generation chambers that do not cause ink ejection from the nozzle. When dummy pressure generation chambers without ink ejection are provided on both the outer sides of such 256 pressure generation chambers through the partition of the piezoelectric substance, it is possible to avoid reduction in the amount of ink ejection from the pressure generation chambers located on both sides of the 256 pressure generation chambers. As will be described later, the dummy pressure generation chamber is supplied with ink, but is not provided with a corresponding nozzle.

Similarly, a dry film 130*b* is bonded on the thin substrate 22*b* of the second piezoelectric material substrate 10*b*, and this dry film 130*b* is subjected to the processing of exposure and development, thereby forming a mask for setting the positions for machining an ink channel and electrode. On the second piezoelectric material substrate 10*b*, 258 channels are formed at the position determined by the mask, using a diamond blade or the like, whereby a pressure generation chamber 28*b* as an ink channel is produced. This arrangement causes the adjacent pressure generation chambers to be separated by the partition of a piezoelectric material. A drive electrode 25*b* is formed on the pressure generation chamber 28*b* by aluminum vapor deposition, and a takeout electrode 160*b* connected to this drive electrode 25*b* is formed.

Then the first piezoelectric material substrate 10*a* and the second piezoelectric material substrate 10*b*, except for the takeout electrodes 160*a* and 160*b* (FIG. 3(*d*)), are provided with the cover substrates 24*a* and 24*b* covering the pressure generation chambers 28*a* and 28*b*. The first piezoelectric material substrate 10*a* and the second piezoelectric material substrate 10*b* are bonded with each other on the sides opposite to the sides provided with the cover substrates 24*a* and 24*b*. Then the central portion is cut off (FIG. 3(*e*)). The portions corresponding to the pressure generation chambers 28*a* and 28*b* are each provided with a nozzle plate 180 equipped with nozzles 18*a* and 18*b* (256 nozzles by two rows), whereby two head main bodies 17Y are manufactured (FIG. 3(*f*)).

At the time of bonding, pressure generation chambers each head are displaced a half pitch with respect to each other, and bonding operation is performed so as to provide a staggered arrangement. Since each head is a 180-dpi head, displacement of the nozzles by a half pitch with respect to each other allows its use as a 360-dpi recording head. This increases the number of nozzles and provides a high-density recording head.

After that, in each of the two head main bodies, the first piezoelectric material substrate 10*a* and the second piezoelectric material substrate 10*b* are connected with the manifolds 19*a* and 19*b* for supplying ink to the pressure generation chambers 28*a* and 28*b*. At the same time, takeout electrodes 160*a* and 160*b* are connected with the flexible cables 5*a* and 5*b* as wiring boards equipped with drive circuits 16*a* and 16*b*, whereby two inkjet head are manufactured at the same time (FIG. 3(*g*)). Simultaneous production of two two-row heads cuts down the head production costs. The two-row head pressure generation chambers are supplied with the yellow ink of one and the same color, and ink is ejected from the nozzle.

In the present embodiment, the nozzles 18*a* and 18*b* in a plurality of nozzle rows are formed integrally in one nozzle plate substrate. This arrangement ensures accurate positioning of the nozzles 18*a* and 18*b* in a plurality of nozzle rows with the minimum error, and permits high precision ejection of the ink particles.

There is no restriction to the piezoelectric material used in the piezoelectric material substrate 10, provided that deformation occurs when voltage is applied. A known material can be used as the piezoelectric material. It can be a substrate made of an organic material. However, the substrate made of a piezoelectric non-metallic material is preferably utilized. For example, the substrates made of this piezoelectric non-metallic material include a ceramic substrate formed by molding and burning, and a substrate formed by coating and lamination. The organic material includes an organic polymer, and a hybrid material of the organic polymer and inorganic substance.

The ceramic substrate includes PZT ($PbZrO_3$—$PbTiO_3$) and third component added PZT. The third component contains $Pb(Mg_{1/3}Nb_{2/3})O_3$, $Pb(Mn_{1/3}Sb_{2/3})O_3$, $Pb(Co_{1/3}Nb_{2/3})O_3$. Further, $BaTiO_3$, ZnO, $LiNbO_3$ and $LiTaO_3$ can also be used to produce it.

The substrate formed by coating and lamination can be produced, for example, by the sol-gel method, laminated substrate coating methods.

No restriction is imposed on the material used to produce the cover substrate 24. The substrate can be made of an organic material. However, the substrate made of a non-piezoelectric non-metallic material is preferably used. To get the substrate made of the non-piezoelectric non-metallic material, it is preferred to choose at least one of alumina, aluminum nitride, zirconia, silicon, silicon nitride, silicon carbide, quartz, and non-polarized PZT. The organic material is exemplified by an organic polymer, and a hybrid material of organic polymer and inorganic substance.

The nozzle plate 180 can be made of a synthetic resin such as polyimide resin, polyethylene terephthalate resin, liquid crystal polymer, aromatic polyamide resin, polyethylene naphthalate resin and polysulfon resin. It is also possible to use such a metallic material as stainless steel.

The metals that can be used for the drive electrode 25 and takeout electrode 160 include platinum, gold, silver, copper, aluminum, palladium, nickel, tantalum and titanium. Especially the gold, aluminum, copper and nickel are preferably used from the viewpoint of electric properties and processability. Plating, vapor deposition and sputtering methods are used for their processing.

In the present embodiment, the partition of the pressure generation chamber is made of the thin substrates as two piezoelectric material substrate having different directions for polarization, and thick substrates. For example, only the thin substrate can be made of the piezoelectric material substrate. It is applicable if at least part of the partition is made of the piezoelectric material substrate.

As described above, the major portion of the shear mode type recording head can be formed merely by forming pressure generation chambers on the piezoelectric material and metallic electrodes on the partition thereof. This simple production method ensures high-density arrangement of a great number of pressure generation chambers, and is preferably used for high-definition image recording.

The head main bodies 17Y, 17M, 17C and 17K for various colors are produced in the manner descried above, and they constitute the head main body 17.

In this head main body 17, positive or negative pressure is applied to the ink inside the pressure generation chamber due to the deformation of the partition, as described above. This partition constitutes a pressurization section.

Overall Electrical Arrangement of the Inkjet Printer

Figure 4:
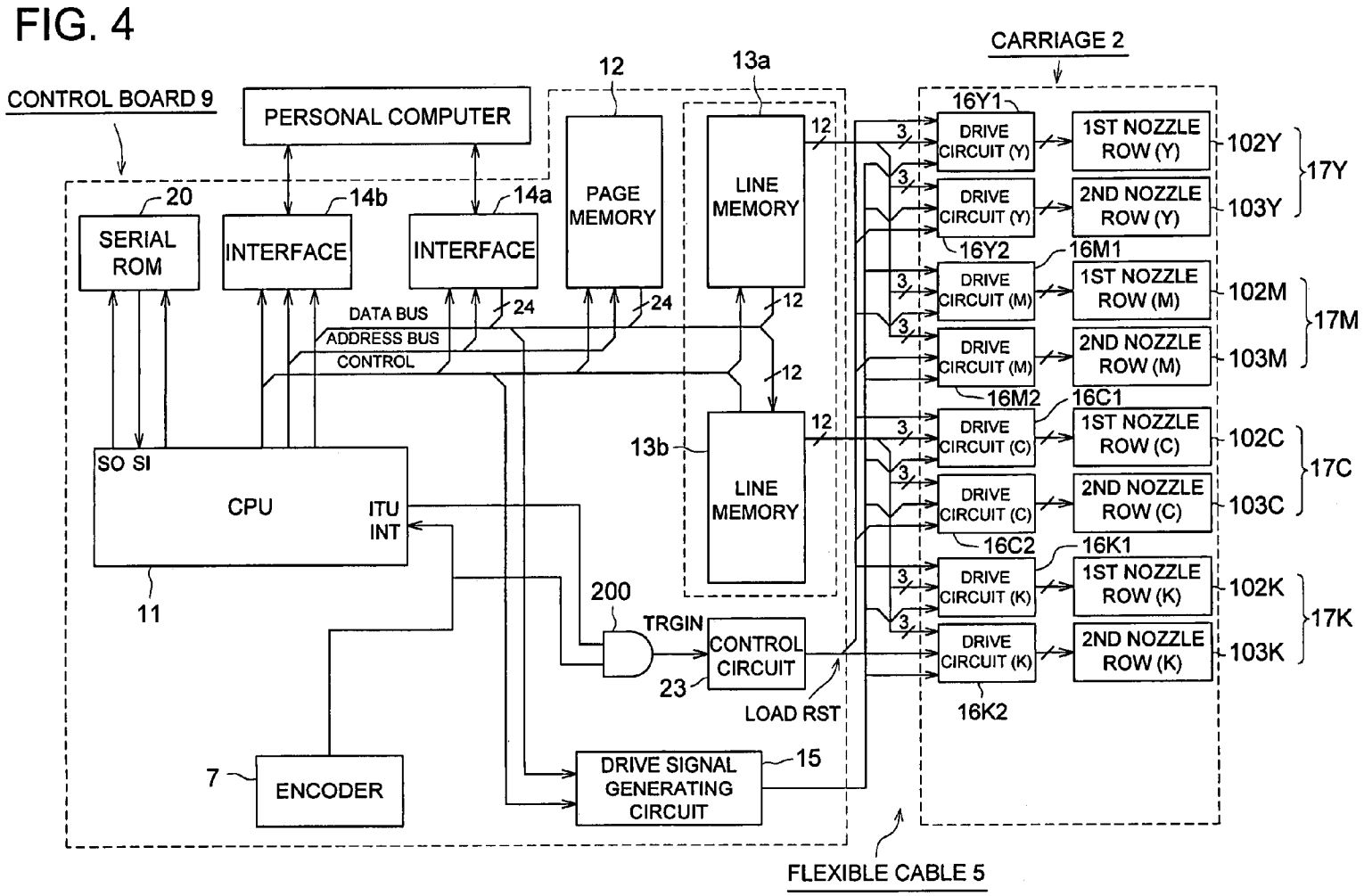
FIG. 4 is a circuit block diagram representing the circuit configuration of the overall inkjet printer 1.

FIG. 4 is a block diagram representing an example of the overall electrical arrangement of the overall inkjet printer as an embodiment of the present invention shown in FIG. 1.

The control board 9 shown by the broken line in FIG. 4 is provided with a CPU11 as a controller for controlling the entire inkjet printer 1. As described above, it is connected with the drive circuit 16 of the carriage 2 by means of the flexible cable 5.

This control board 9 ensures that the timing for storing the ejection data of the first storage section as characteristic configuration of the present invention into the first latch section is adjusted for synchronization among a plurality of nozzle rows, and the timing for storing the ejection data of the first latch section into the second latch section is adjusted independently among a plurality of nozzle rows.

The page memory 12 stores the image data as the ejection data received from a personal computer or the like that uses the ink jet printer 1 as peripheral equipment. The storage capacity of the page memory 12 can be determined by the number of bits of the image data handled by the personal computer, the number of dots, signal transfer speed, CPU processing speed and others.

At the time of recording on the recording paper P, the line memories 13*a* and 13*b* are used as line memories for storing the image data of each pixel to be recorded in the form arranged in a single line in the sub-scanning direction. Each piece of image data constitutes gradation data of several bits, and is transferred from the page memory 12. In the present embodiment, line memories 13*a* and 13*b* for 12-bit processing are used in parallel. It is also possible to use one line memory for 24-bit processing.

The data signal line (data bus) from the page memory 12 is designed as a 24-bit signal line, and is branched to conform to 12 bits for each of the line memories 13. The image data of the line memory 13*a* and 13*b* is transferred to the drive circuit 16 through the flexible cable 5.

The interfaces 14*a* and 14*b* are used to exchange data with an external personal computer. They are formed of either various types of serial interfaces or parallel interfaces.

Further, both the display and input functions are provided. An operation input section (not illustrated) is also provided so that instruction operations can be performed on the control board 9 such as various settings and recording instructions, for example, the setting for selection of either the mode of recording in the outward direction or bi-directional recording mode, and the setting of the data for the table of the output pattern register 34 to be described later.

The drive circuits 16Y1, 16Y2 through 16K1, and 16K2 are formed of ICs. In the present embodiment, one drive circuit is provided for each nozzle row (a total of eight) for each of four colors (Y, M, C and K).

Each drive circuit 16 is equipped with two cascade-connected shift registers of 3 bits by 128 channels. The image data sent from the line memories 13*a* and 13*b* is stored in the shift register. The shift register constitutes the first storage section.

In the present embodiment, the image data of first nozzle row for yellow (Y) is transferred from the line memory 13*a* to the drive circuit 16Y1 through the 3-bit data signal line.

Similarly, the image data of second nozzle row for yellow (Y) is transferred to the drive circuit 16Y2. The 512 pieces of yellow image data sent to the drive circuits 16Y1 and 16Y2 are subjected to parallel processing, and recording is carried out by the head main body 17Y.

Similarly, the image data for magenta (M) is sent from the line memory 13*a* to the drive circuits 16M1 and 16M2, and recording is carried out by the head main body 17M. The image data for cyan (C) is sent from the line memory 13*b* to the drive circuits 16*c*1 and 16*c*2, and recording is carried out by the head main body 17C. The image data for black (K) is sent from the line memory 13*b* to the drive circuits 16K1 and 16K2, and recording is carried out by the head main body 17K. The details of the operation of these drive circuits 16 will be described later. Control is provided to ensure that the image data corresponding to the nozzle row is transferred and stored into the shift register of each drive circuit 16 corresponding to the nozzle row through the control board 9 at the intervals timed for synchronization among a plurality of nozzle rows. This arrangement ensures synchronization of data transmission to the shift register of the plurality of drive circuits corresponding to a plurality of nozzle rows, with the result that efficiency of data transmission trigger processing is improved and control section structure is simplified.

The carriage 2 starts one reciprocating motion based on the information detected by the encoder 7. When it has reached a predetermined position on the outward path or homeward path, the AND gate 200 allows the TRIGIN signal to be outputted to the control circuit 23. Upon receipt of the TRIGIN signal, the control circuit 23 outputs the first trigger signal to each drive circuit 16. In each drive circuit, this first trigger signal allows the ejection data of the shift register to be stored in the first latch section. Thus, the timing for storing the ejection data of the shift register in the first latch section is adjusted for synchronization among a plurality of nozzle rows.

Further, after the lapse of a predetermined time corresponding to the displacement at a pitch finer than the pixel pitch unit among a plurality of nozzle rows, the control circuit 23 allows the second trigger signal to be outputted to each drive circuit at the intervals timed independently in accordance with the displacement among various nozzle rows (displacement at a pitch finer than the pixel pitch) and permits the ejection data of the first latch section to be stored in the second latch section. Based on the ejection data stored in the second latch section, the drive circuit sends the drive waveform to the pressurization section, whereby ink is ejected from each nozzle row.

The timing for ejecting ink particles from each nozzle row is controlled independently for each of a plurality of nozzle rows by means of the control board 9. This arrangement ensures the position of the arrival of ink particles for each nozzle row to be adjusted at a pitch finer than the pixel pitch.

The drive circuits 16Y1 through 16K2 each supply the drive waveform to the shear mode piezoelectric device provided on the nozzles of the head main bodies 17Y through 17K, through the 256-bit data signal line. Upon receipt of this drive waveform, the shear mode piezoelectric device is deformed, whereby ink in the head of each color is ejected.

The drive signal generation circuit 15 generates a single drive signal made up of a plurality of drive waveforms and supplies it to each of the drive circuits 16, as will be described later. The drive waveform must be changed according to the image data. Three drive signals (a drive signal of pulse_timing0 including the non-ejection waveform as basic waveform, a drive signal of pulse_timing1 including the non-operation waveform as basic waveform, and a drive signal of pulse_timing2 including the ejection waveform as basic waveform) are stored in the line memory (not illustrated) inside the drive signal generation circuit 15 as digital data. This line memory can be formed of the SRAM or the like.

In the present embodiment, the 3-bit (8-gradation) data for each color is outputted. The waveform data stored in the line memory is formed of the digitalized waveform wherein the GND waveform is added to the leading edge, and basic waveforms are repeated seven times. The details of the basic waveform will be described later. The ejection waveform and non-operation waveform are both square wave pulses.

A plurality of ink particles are recorded on the recording paper P within one pixel cycle by a plurality of ejection waveforms. Recording in the area corresponding to the number of ink particles is enabled by the image data, and gradation recording can be provided.

The amount of ink to be ejected can be changed by using the different waveform as the ejection waveform. Further, the gradation property can be improved.

The 3-bit (8-gradation) data is used as an example. Other data can also be used. In that case, one has only to change the number of bits (gradations) and line memory data in synchronism with each other.

Electrical Arrangement of the Inkjet Head Drive Circuit

Figure 5:
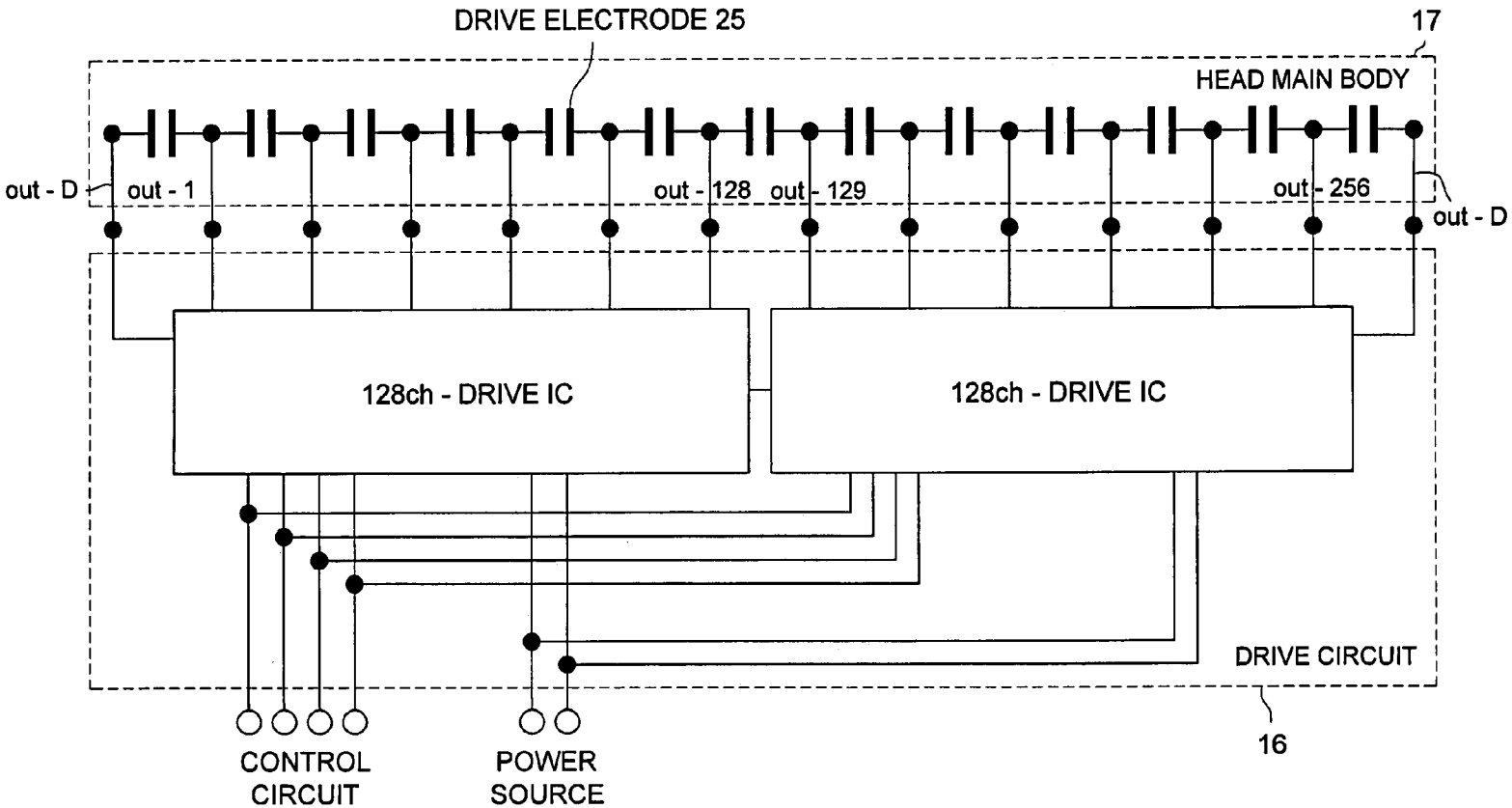
FIG. 5 is a block diagram showing the drive circuit configuration.
Figure 6:
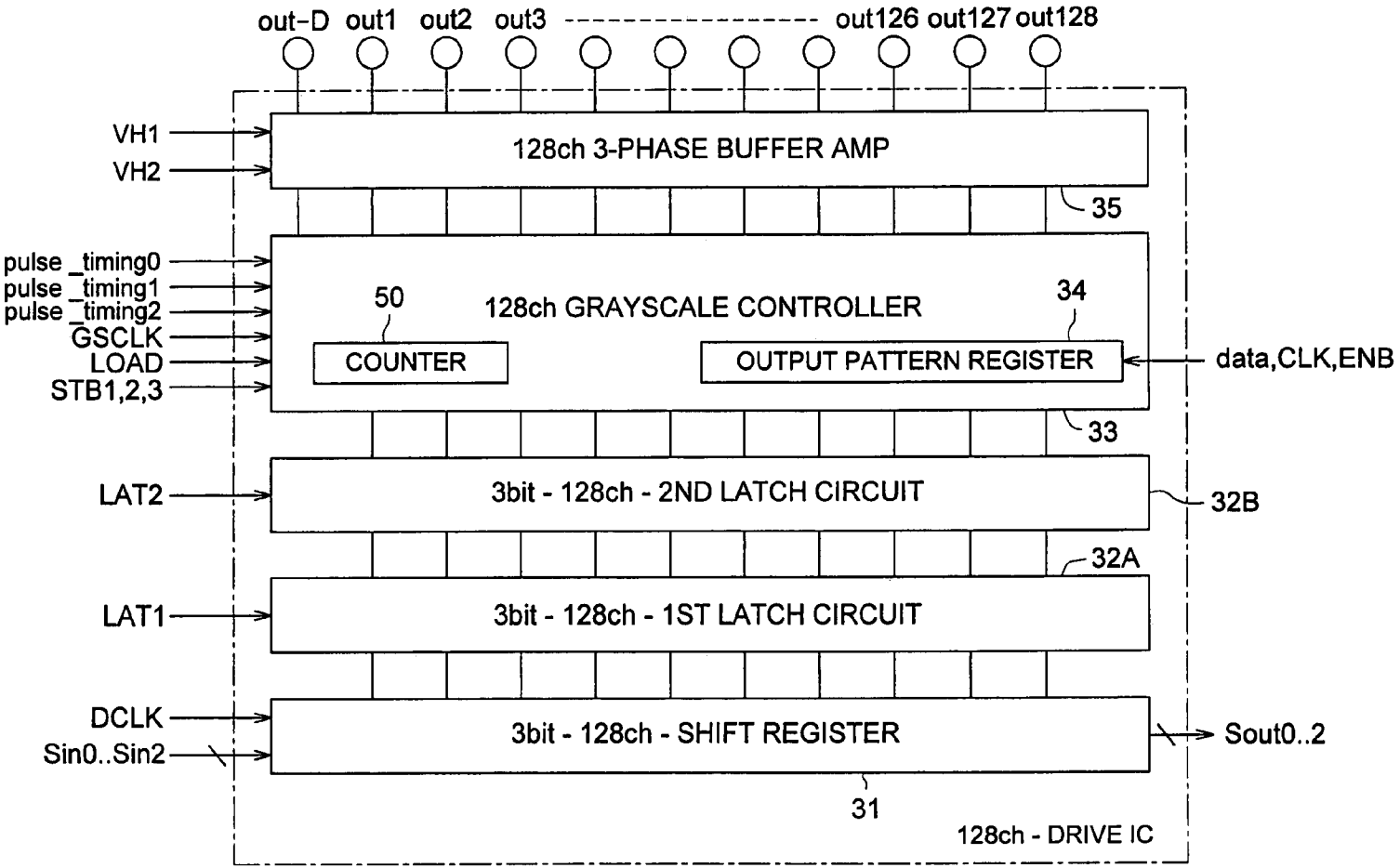
FIG. 6 is a block diagram showing the details of the drive circuit configuration.

The following describes the electrical arrangement of the drive circuit 16 of the head as a characteristic structure of the present invention, with reference to the block diagram representing the details of the drive circuit of FIGS. 5 and 6:

FIG. 5 is a diagram representing the details of the drive circuit 16 for each row of each color head, namely, for 256 nozzles. FIG. 6 is a block diagram showing the details of the drive IC for 128 nozzles of FIG. 5. In this case, the arrangement of the drive circuit 16Y1 of the head main body 17Y will be described. The same description applies to the arrangement of the 16Y2 and the drive circuits 16M1 through 16K2 of the head main bodies 17M through 17K.

The drive circuit 16Y1 of the present invention is equipped with two drive ICs for 128 channels (nozzles) as shown in FIG. 5. The shift registers 31 of 3 bits by 128 channels (nozzles) within each drive IC are cascade connected, and the piezoelectric devices for 256 channels (nozzles) are driven. The drive electrodes and drive circuits of the dummy pressure generation chambers on both ends are also connected thereto (corresponding to the out-D), and the drive waveform pattern to be described later is added thereto.

These two drive ICs have basically the same arrangement. FIG. 6 shows the details of one of them.

Each of the drive ICs of 128 channels of FIG. 6 is made of a first latch circuit 32A of the 3-bit×128 channels (nozzles) as the first latch section; a first latch circuit 32B of the 3-bit×128 channels (nozzles) as the second latch section; a shift register 31 as the first storage section for outputting the image data to the first latch circuit 32A; the gray scale controller 33 as a drive means for driving the pressurization section based on the ejection data; an output pattern register 34 as a second storage section; and a three-phase buffer amplifier 38. Such a register as the output pattern register 34 is preferably used the second storage section.

In the present embodiment, in order to process the image data made of 8 gradations per pixel, each component of the drive circuit 16 is arranged to be compatible with 3 bits. In synchronism with the transfer clock DCLK inputted from the control circuit 23, several bits for each pixel—3-bit image data in this case—are sent to the shift register 31 of the drive circuit 16 from the line memory 13 on a serial basis in units of a pixel. Timing for this transfer is adjusted for synchronization among nozzle rows, and is standardized in the present example.

FIG. 6 shows that the first 3-bit pixel data —Sin0, Sin1 and Sin2— is sent through the 3-bit data signal line. Further, image data that cannot be incorporated in this shift register is outputted as Sout0, Sout1 and Sout2 to the shift register cascade-connected in the downstream stage, and is stored therein.

The shift register 31 is capable of storing the image data incorporating the number of pixels equivalent to the one-time ejection from the 128 nozzles of the nozzle head 17. In the present embodiment, connection of these two shift registers 31 makes it possible to store the image data for 256 pixels corresponding to the one-row nozzles arranged in the sub-scanning direction. When the carriage 2 has reached a predetermined position, the control circuit 23 outputs LAT1 signal as the first trigger signal designating the time of latching. Upon receipt of this LAT1 signal, the first latch circuit 32A latches the image data outputted in parallel from the shift register 31.

When the carriage 2 has reached the position suited for recording, the control circuit 23 outputs the LAT2 signal as the second trigger signal indicating the latching timing. Upon receipt of the LAT2 signal, the second latch circuit 32B latches the image data outputted in parallel from the first latch circuit 32A. The image data latched by the second latch circuit 32B is outputted to the gray scale controller 33.

A standardized trigger signal is preferably used for the first trigger signal and the second trigger signal. This reduces the number of the trigger input signal lines for latching timing.

To put it more specifically, the pulse signal having two edges—a rising edge and a falling edge—should be used as a standardized trigger signal, wherein one of the two edges is used for the first trigger signal, and the other for the aforementioned the second trigger signal. This arrangement provides a trigger signal of simple structure standardized for latching timing. Further, modification of the pulse width allows easy change of the two latching timings.

As described above, the image data outputted from the shift register 31 is latched by the second latch circuit 32B via the first latch circuit 32A.

Thus, arrangement of two latch sections ensures synchronized data transmission to the shift register of a plurality of drive circuit corresponding to a plurality of nozzle rows, without having to overly improve data transmission speed or reduce the recording speed. It also enables efficient data transmission trigger processing. The aforementioned arrangement further ensures simplified configuration of the control section, and permits adjustment of the position of the ink particle arrival for each nozzle row at a pitch finer than the pixel pitch.

Three drive signals (a drive signal of pulse_timing0 including the non-ejection waveform, a drive signal of pulse_timing1 including the non-operation waveform, and a drive signal of pulse_timing2 including the ejection waveform) are inputted into the gray scale controller 33 from the drive signal generation circuit through the input terminal.

The gray scale controller 33 provides a control means wherein the pressure generation chambers corresponding to 256 nozzles are divided into three groups —group A, group B and group C—by the selection signals STB-1, 2 and 3 supplied from the input terminal, and the corresponding piezoelectric devices are driven on the division basis. The group A is selected for STB-1, the group B for STB-2, and the group C for STB-3. Ink particles are ejected sequentially from respective corresponding nozzles.

The gray scale controller 33 has a counting section. 50 for counting the waveforms to check the ordinal number of the outputted waveform in the drive waveform pattern. It reads the GSC (grayscale count) as a count of this counting section 50 from 0 through 7.

The gray scale controller 33 is equipped with an output pattern register 34 storing the conversion table as information defining the relationship between the image data as ejection data and the drive waveform pattern data corresponding to a plurality of drive waveforms for driving the pressurization section.

In the first place, the counting section is reset according to the inputted LOAD signal. Then the STB-1 is selected, and the pressure generation chambers (nozzles) of the group A is selected. From the image data corresponding to each of pressure generation chambers (nozzles) of the group A, the drive waveform pattern data is determined according to the conversion table in the output pattern register 34. For the pressure generation chambers of the groups B and C without being driven, predetermined drive waveform pattern data is selected. The GSCs as count values of the aforementioned counting section are counted up one by one from zero (0), so that the drive waveform to be outputted is determined. In response to the image data and the count of the counting section, one of three drive waveforms—a non-operation waveform, non-ejection waveform, and ejection waveform—is selected. In synchronism with the GSCLK timing signal having been inputted, this drive signal is selected by the switching section (not illustrated) and is outputted.

The three-phase buffer amplifier 35 shifts the drive waveform outputted from the gray scale controller 33, to the level of power voltage required to drive the piezoelectric device. In this case, the ejection waveform drive voltage is determined by the voltage value VH1 inputted from the input terminal, and the non-operation waveform drive voltage is determined by the voltage value VH2 inputted in the similar manner. After having been level-shifted, they are outputted to the respective corresponding piezoelectric devices. Thus, ink particles are ejected from the corresponding nozzle. Changing the voltage values VH1 and VH2 allows the drive voltage of the ejection waveform and non-operation waveforms to be adjusted to the optimum level.

When the counting section has counted GSC=7, the system determines that ejection of the ink particles from the pressure generation chambers (nozzles) of the group A has completed. Then the counting section 50 is reset in response to the LOAD signal, and the group B is selected according to the STB-2 signal. For the group B, ink particles are ejected in the similar manner. Upon completion of the group B, ink ejection is performed for the group C. Thus, ink ejection for all the nozzles in one row terminates. In this manner, the recording procedure is repeated according to the next image data.

Relationship Between Image Data and Drive Waveform Pattern

FIG. 7 shows an example of the conversion table for the image data and drive waveform pattern data.

Since the image data is 3-bit, 8-gradation data, the gradation value 0 is represented as (0, 0, 0), gradation value 1 as (0, 0, 1), gradation value 2 as (0, 1, 0), gradation value 3as (0, 1, 1), gradation value 4 as (1, 0, 0), gradation value 5 as. (1, 0, 1), gradation value 6 as (1, 1, 0), and gradation value 7 as (1, 1, 1).

The drive waveform pattern data corresponds to eight drive waveforms ranging from the first drive waveform to the eighth drive waveform corresponding to the count values GSC=0 through 7 of the aforementioned counting section. This allows three different values of 0, 1 and 2 to be assumed.

The data is outputted from the bit located at the last position. Thus, for the gradation values (0, 1, 1) in the Table of FIG. 7, for example, drive waveform pattern data (1, 1, 1, 2, 2, 2, 1, 0) is selected and drive waveform pattern data (0, 1, 2, 2, 2, 1, 1, 1) is outputted. The outputted drive waveform pattern corresponds to the aforementioned count value GSC=0 through 7. In this case, 0 is outputted as drive waveform data when the count value of the aforementioned counting section is GSC=0; 1 is outputted when the count value is GSC=1; 2 is outputted when the count value is GSC=2; 2 is outputted when the count value is GSC=3; 1 is outputted when the count value is GSC=5; 1 is outputted when the count value is GSC=6; and 1 is outputted when the count value is GSC=7.

As described above, the STB signal divides pressure generation chambers corresponding to 256 nozzles into three groups —group A, group B and group C— by the three division signals, STB-1, STB-2 and STB-3, and the corresponding piezoelectric devices are driven on the division basis.

In the Table of FIG. 7, when the piezoelectric device of the pressure generation chamber in the group A is driven at n=1, drive waveform pattern data is selected in response to the image data for the pressure generation chambers of the group A, as described above. For the pressure generation chambers of the groups B and C corresponding to n=2 and 3, the drive waveform pattern data (1, 1, 1, 1, 1, 1, 1, 0) is selected independently of the image data, and (0, 1, 1, 1, 1, 1, 1, 1) is outputted.

Similarly, when the piezoelectric device of the pressure generation chamber in the group B is driven at n=2, drive waveform pattern data is selected in response to the image data for the pressure generation chambers of the group B, as described above. For the pressure generation chambers of the groups A and C corresponding to n=1 and 3, the drive waveform pattern data (1, 1, 1, 1,.1, 1, 1, 0) is selected independently of the image data, and (0, 1, 1, 1, 1, 1, 1, 1) is outputted.

Similarly, when the piezoelectric device of the pressure generation chamber in the group C is driven at n=3, drive waveform pattern data is selected in response to the image data for the pressure generation chambers of the group C, as described above. For the pressure generation chambers of the groups A and B corresponding to n=1 and 2, the drive waveform pattern data (1, 1, 1, 1, 1, 1, 1, 0) is selected independently of the image data, and (0, 1, 1, 1, 1, 1, 1, 1) is outputted.

Thus, when the count value of the counting section is GSC=0, drive waveform data 0 is selected in any one of the pressure generation chambers of the groups A, B and C, without the piezoelectric device being driven. In the case of GSC=1 through 7, the piezoelectric device is driven in response to drive waveform data, as shown below.

Further, for the drive electrode for the aforementioned dummy pressure generation chamber, drive waveform pattern data (1, 1, 1, 1, 1, 1, 1, 0) is selected as the out-D, and data (0, 1, 1, 1, 1, 1, 1, 1) is outputted. This arrangement causes the partition of the dummy pressure generation chamber to be driven in response to the drive waveform applied to the electrode in response to the image data of the pressure generation chambers on both ends of the 256 pressure generation chambers.

Figure 8:
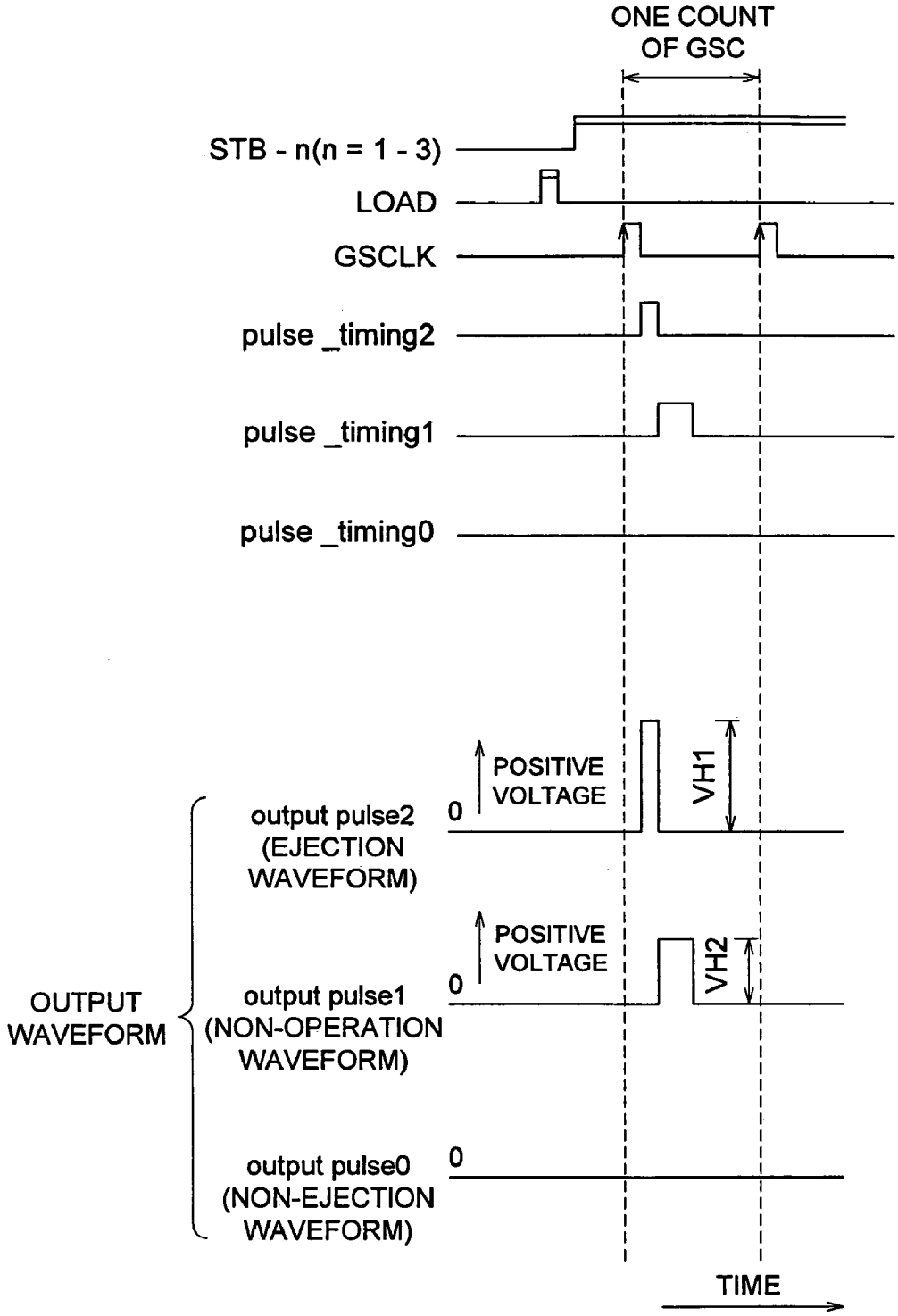
FIG. 8 is a diagram defining the relationship between the drive waveform pattern data and drive waveform output.

FIG. 8 shows the drive waveform data, the drive waveform outputted to the piezoelectric device and the timing.

In FIG. 8, the horizontal axis represents time, and the vertical axis of the drive waveform indicates the drive voltage. This diagram shows the area equivalent to one drive waveform, namely, one count of the GSC.

Figure 9:
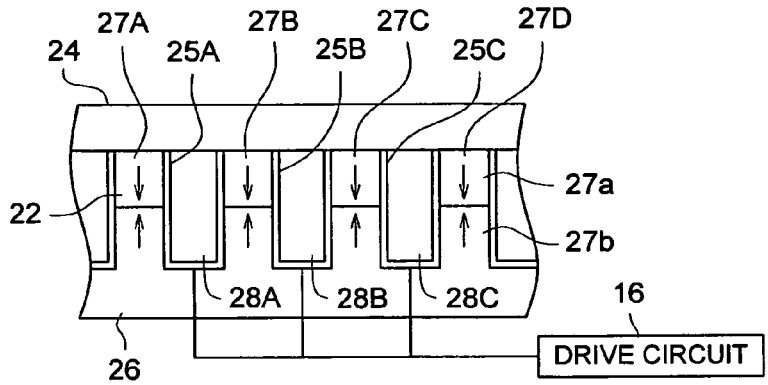
FIGS. 9(*a*) through (*c*) indicate the basic operation of the shear mode inkjet head by the drive waveform.
Figure 9:
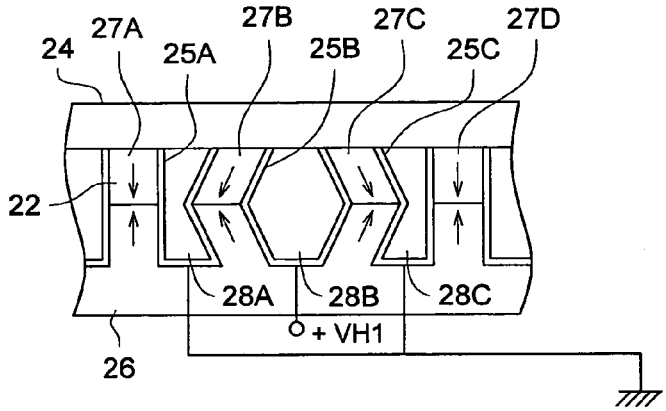
Figure 9:
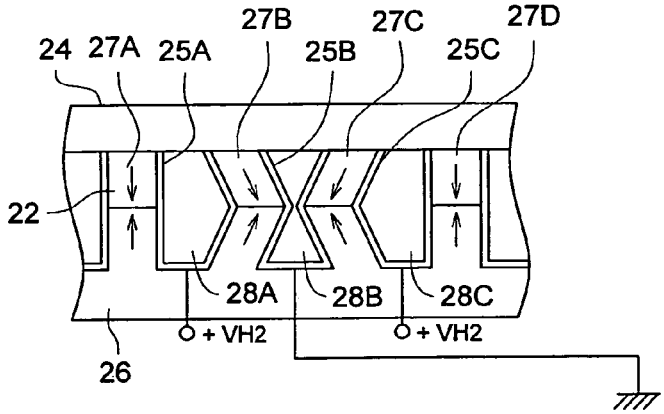
Figure 10:
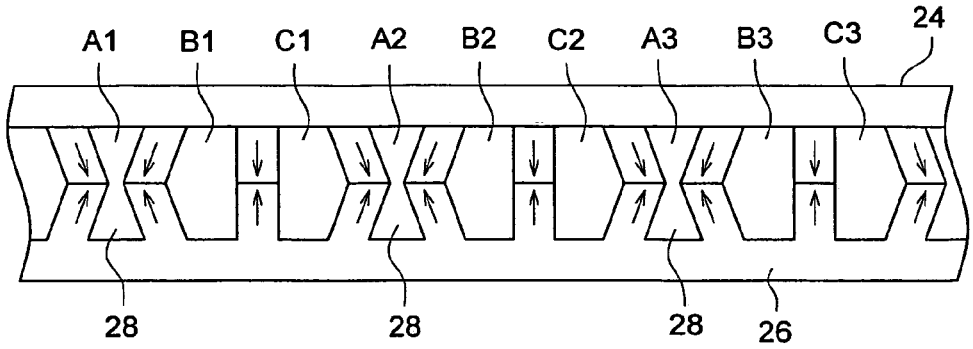
FIGS. 10(*a*) through (*c*) indicate the operations in the separate drive of the shear mode inkjet head.
Figure 10:
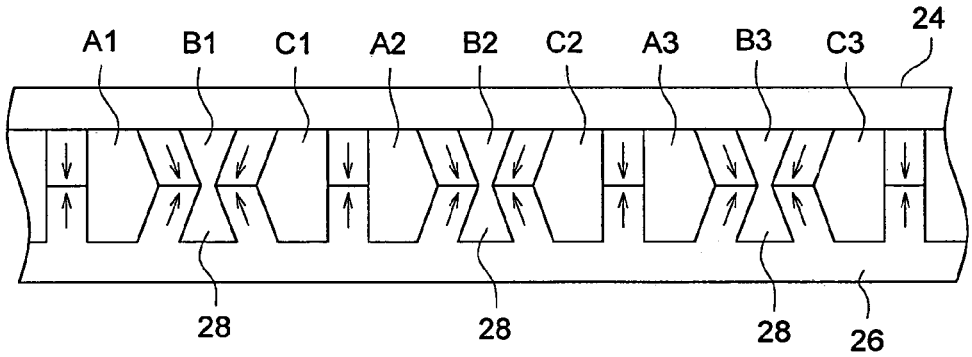
Figure 10:
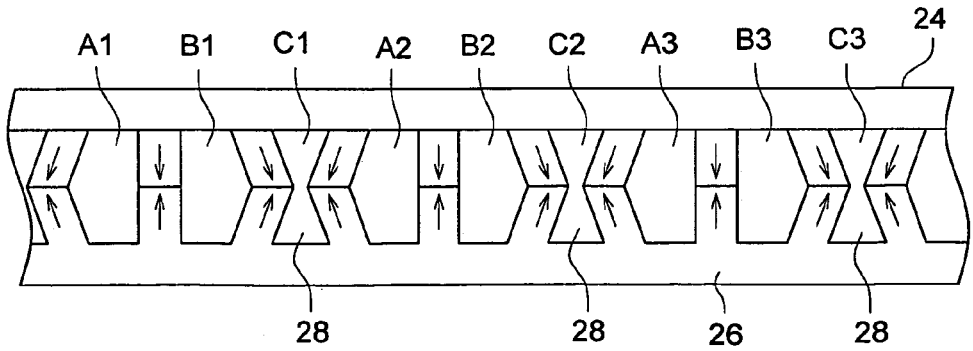

FIG. 9 indicates the basic operation of the shear mode head by the drive waveform. It shows three pressure generation chambers 28A, 28B and 28C constituting a part of one nozzle row of the head main body 17Y. It is assumed that the pressure generation chamber 28B is the pressure generation chamber of the group selected by the STB signal as a division-based drive signal, and is driven according to the image data. It is also assumed that the 28A and 28C are the pressure generation chambers of the groups not yet selected. FIG. 10 shows the operation of the shear mode inkjet head during the division-mode drive. It shows a reduced volume version of the pressure generation chamber.

FIGS. 9 and 10 show the cross sections of the head main body wherein the nozzle is not illustrated. The drive electrode is not illustrated in FIG. 10. In these diagrams, the same reference numerals are used to denote the same numbers as those of FIG. 3. Numeral 27 denotes a partition.

One nozzle row 17Y will be described. The same description applies to other nozzle rows.

In FIG. 8, when the aforementioned drive waveform data is "0", the drive signal pulse_timing0 corresponding to the non-ejection waveform is selected, and the GND (ground) as a non-ejection waveform is applied to the piezoelectric device of the pressure generation chamber corresponding to the image data. For the pressure generation chamber of the group not yet selected, the drive waveform data "1" is selected, as described above. The drive signal pulse_timing1 corresponding to the non-operation waveform is selected, and the square wave pulse of positive voltage of the voltage value VH2 as the non-operation waveform is applied to the piezoelectric device of the pressure generation chamber.

Thus, when this recording head main body 17Y is in the state shown in FIG. 9(*a*), the electrode 25B of the pressure generation chamber corresponding to the image data is connected to the ground. At the same time, the square wave pulse of the positive voltage of the voltage value VH2 as the non-operation waveform is applied to the electrodes 25A and 25C of the pressure generation chamber of the group not yet selected. Then the initial rise of the pulse causes the electric field to be produced in the direction at right angles to the direction of polarization of the piezoelectric materials 27*a* and 27*b* constituting the partitions 27B and 27C. Shear deformation occurs on the joint surface of the partition as well as on the partitions 27B and 27C. As shown in FIG. 9(*c*), both the partition 27B and 27*c* are mutually deformed inside, with the result that the volume of the pressure generation chamber 28B is reduced. This deformation allows pressure to be applied inside the pressure generation chamber 28B to the extent that ink particles are not ejected.

After the lapse of a predetermined time, the potential of the electrodes 25A are 25C are brought back to "0" by the fall of the pulse. The partitions 27B and 27C go back to the neutral position of FIG. 9(*a*) from the shrunken position.

Thus, partitions 27B and 27C of the piezoelectric device of the pressure generation chamber 28B corresponding to image data are deformed in response to the drive waveform without ink particles being ejected from the nozzle. The surface of ink at the tip of the nozzle is kept vibrating without ink particles being ejected from the nozzle, whereby drying of ink is prevented. Further, this makes it possible to heat the ink using the heat generated by the drive of the pressurization section by the non-ejection waveform. Heating reduces the viscosity of ink, which can be easily ejected. Temperature distribution of ink among pressure generation chambers can be corrected if any.

In FIG. 8, when the aforementioned drive waveform data is "1", the drive signal pulse_timing1 corresponding to the non-operation waveform is selected, and the square waveform pulse of positive voltage of the voltage value VH2 as a non-operation waveform is applied to the piezoelectric device of the pressure generation chamber corresponding to the image data. For the pressure generation chamber of the group not yet selected, the drive waveform data "1" is selected, as described above. In the similar manner, the square waveform pulse of positive voltage of the voltage value VH2 as a non-operation waveform is applied to the piezoelectric device of the pressure generation chamber.

Thus, when this recording head main body 17Y is in the state shown in FIG. 9(*a*), the square waveform pulse of positive voltage of the voltage value VH2 as a non-operation waveform is applied, together with the electrode 25B corresponding to the pressure generation chamber and the electrodes 25A and 25C of the pressure generation chamber of the group not selected. Since any potential difference does not occur, the partitions 27B and 27C of the piezoelectric device pressure generation chamber 28B corresponding to the image data are not driven, and no deformation occurs.

In FIG. 8, when the aforementioned drive waveform data is "2", the drive signal pulse_timing2 corresponding to the ejection waveform is selected, and the square waveform pulse of the voltage value VH1 as an ejection waveform is applied to the piezoelectric device of the pressure generation chamber corresponding to the image data. For the pressure generation chamber of the group not yet selected, the drive waveform data "1" is selected, as described above. The drive signal pulse_timing1 corresponding to the non-operation waveform is selected, and the square wave pulse of positive voltage of the voltage value VH2 as the non-operation waveform is applied to the piezoelectric device of the pressure generation chamber. The square wave pulse of this ejection waveform is not timed with that of the non-operation waveform, so that the square wave pulse of the non-operation waveform is outputted following the square wave pulse of the ejection waveform.

Thus, when this recording head main body 17Y is in the state shown in FIG. 9(*a*), the square wave pulse of the voltage value VH1 is applied to the electrode 25B of the pressure generation chamber corresponding to the image data. At the same time, the initial ground portion of the non-operation waveform is applied to the electrodes 25A and 25C of the pressure generation chamber of the group not yet selected. Then the initial rise of the pulse causes the electric field to be produced in the direction at right angles to the direction of polarization of the piezoelectric materials 27*a* and 27*b* constituting the partitions 27B and 27C. Shear deformation occurs on the joint surface of the partition as well as on the partitions 27B and 27C. As shown in FIG. 9(*b*), both the partition 27B and 27*c* are mutually deformed outside, with the result that the volume of the pressure generation chamber 28B is reduced. This causes a negative pressure to occur to the ink inside the pressure generation chamber 28B, with the result that ink flows inside. After the lapse of a predetermined time, the pulse potential is set back to zero (0). Then partitions 27B and 27C go back to the neutral position shown in FIG. 9(*a*) from the expanded position, and a high pressure is applied to the ink inside the pressure generation chamber 28B.

After that, when the electrode 25B of the pressure generation chamber corresponding to the image data is connected to the ground, a square wave pulse of VH2 is applied to the electrodes 25A and 25C of the pressure generation chambers of the group not to be driven. Then the partitions 27B and 27C are mutually deformed inside by the rising pulse as shown in FIG. 9(*c*), with the result that the volume of the pressure generation chamber 28B is reduced. This shrinkage allows higher pressure to be applied to the ink inside the pressure generation chamber 28B, so that ink particles are ejected from the nozzle 28. After the lapse of predetermined time, the pulse potential is reduced back to zero (0), and the partitions 27B and 27C go back to the neutral position of FIG. 9(*a*) from the shrunken position.

In the present embodiment, eight gradations are used, and the drive waveform pattern contains seven drive waveforms, except for the ground portion of the leading edge. This arrangement provides multi-drop ejection, wherein the aforementioned operation is repeated seven times so that a maximum of seven ink particles are ejected within one pixel cycle.

This multi-channel shear mode inkjet head is driven in three cycles using groups A, B and C, as described above.

The following describes the further details of the aforementioned 3-cycle ejection operation with reference to FIGS. 10(*a*) through (*c*). FIGS. 10(*a*) through (*c*) show the head main body 17Y, wherein nine pressure generation chambers A1, B1, C1, A2, B2, C2, A3, B3, C3 constituting part of 256 one-row pressure generation chambers are represented.

In the process of ink ejection, a drive waveform is applied to the electrode of each of the pressure generation chambers 28 of the group A (A1, A2, A3) according to image data (FIG. 10(*a*)). A non-operation waveform is applied to the pressure generation chambers of group B (B1, B2, B3) and pressure generation chambers of group C (C1, C2, C3).

Subsequently, the aforementioned operation is made to the pressure generation chambers 28 of group B (B1, B2, B3) (FIG. 10(*b*)), then to the pressure generation chambers 28 of group C (C1, C2, C3) (FIG. 10(*c*)).

In the aforementioned shear mode type inkjet recording head, deformation of the partition 27 is caused by the difference in voltages applied to the electrodes on both sides of the partition. In the present embodiment, a negative voltage is applied to the electrode of the pressure generation chamber for ink ejection.

Accordingly, instead of using this method, it is also possible to connect the electrode of the pressure generation chamber for ink ejection to the ground and to apply a positive voltage to the electrodes of the pressure generation chambers adjacent thereto. This arrangement uses only positive voltage for driving, and preferably cuts down the power source cost.

The ejection waveform and non-operation waveform are square wave pulses having a predetermined wave height. On the assumption that 0 volt is 0% and wave height voltage is 100%, the pulse width is defined as a period between the time when a pulse voltage rises or falls 10% from 0 volt at the start, and the time when the pulse voltage falls or rises 10% from the wave height in one pulse. The square wave is defined as a waveform wherein both the rise and fall time between 10 and 90% of the voltage do not exceed 0.5 μsec. Use of the square wave ensures highly responsive driving of the inkjet head to eject ink particles. In the ink particle ejecting method using the resonance of pressure wave, this arrangement provides more effective and sensitive driving of the inkjet head.

The AL (acoustic length) is defined as half the acoustic resonance cycle of the pressure generation chamber. It is obtained as a pulse width where ink particle ejection speed is maximized by measuring the speed of the ink particles ejected by the square wave pulse applied to the partition 27 as a pressurization section, and by changing the square wave pulse width with the square wave voltage value kept constant.

Assume that the relationship between the drive voltage VH1 (V) of the square wave pulse of the ejection waveform and the drive voltage VH2 (V) of the square wave pulse of the non-operation waveform is $|VH1|>|VH2|$, as in the aforementioned embodiment. This arrangement ensures easy canceling of the residual pressure wave subsequent to ink particle ejection, stable ejection by high frequently driving and adequate vibration of the ink inside the nozzle. For these advantages, this arrangement is preferably utilized.

The pulse width of the square wave pulse ejection waveform is preferably in the vicinity of the 1 AL, namely, in the range from 0.5 AL through 1.4 AL. This will increase ink particle ejection pressure (ejection speed) and will provide the most efficient ejection force.

The pulse width of the square wave pulse of the non-operation waveform is preferably in the vicinity of the 2 AL, namely, in the range from 1.6 AL through 2.5 AL. This arrangement ensures easy canceling of the residual pressure wave.

The reference voltage for voltage VH1 and voltage VH2 is not always 0. The voltage VH1 and voltage VH2 each are differential voltages.

Figure 11:
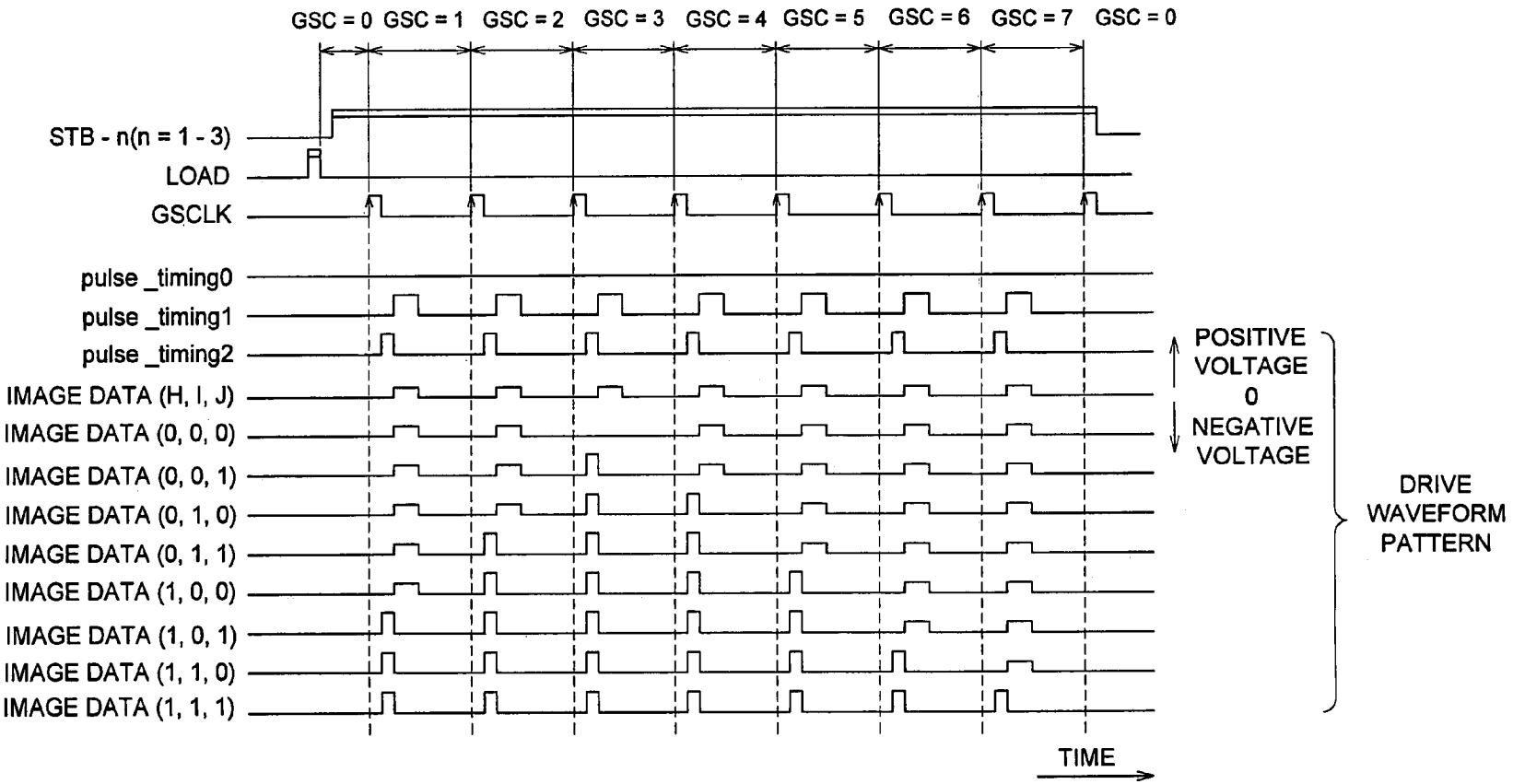
FIG. 11 is a diagram representing the image data and drive waveform pattern.

FIG. 11 shows the drive waveform pattern corresponding to the Table of FIG. 7, drive waveform output and timing chart. In this case, driving for the pressure generation chamber selected by division-based drive, for example, that for one pixel of group A is illustrated. Although the drive waveform pattern applied to the dummy pressure generation chamber is not shown, the drive waveform pattern when the image data of FIG. 11 is (H, I, J) is applied to the dummy pressure generation chamber drive electrode.

In the first place, the counting section is reset to 0 in response to the inputted LOAD signal. For example, the STB-1 is selected, then the pressure generation chamber of group A is selected. Based on the image data corresponding to the group A, the drive waveform pattern data is determined according to the conversion table stored in the output pattern register 34. A predetermined drive waveform pattern is selected for the pressure generation chambers of groups B and C not driven. The GSC as the count value of the aforementioned counting section is counted up by one from 0 to 7, whereby the drive waveform to be outputted is determined. In conformity to the image data and the count of the counting section, the drive waveform is selected from among three drive waveforms; non-operation waveform, non-ejection waveform and ejection waveform. The aforementioned drive signals are synchronized with the timing signal of the GSCLK having been inputted. The drive waveform is selected by the switching section (not illustrated) and is outputted.

In the present embodiment, when the image data is (0, 0, 0) and the gradation value is 0, the non-ejection waveform is applied at the count of GSC=3, i.e. in the case of the 4th waveform, Approximately at the center of the non-ejection pixel, the surface of ink at the tip end of the nozzle can be vibrated, whereby ink is prevented from getting dried effectively and efficiently.

When the image data is (0, 0, 1) and the gradation value is 1, ink is ejected at the count of GSC=3, i.e. in the case of the 4th waveform. This allows a dot of the first ink particle to be located approximately at the center of one pixel. When the image data is (0, 1, 0) and the gradation value is 2, ink is ejected at the count of GSC=3, i.e. in the case of the 4th waveform and at the count of GSC=4, i.e. in the case of the 5th waveform. This allows a total of two dots of ink particles to be arranged approximately at the center of one pixel. Similarly, with the increase in the gradation value, the position of the dot can be changed from the center of the pixel to the peripheral portion, whereby the gravity center of the dot can be adjusted using the low-gradation and high-gradation dots.

As described above, bit data is assigned to each drive waveform to produce drive waveform pattern data. This permits a desired waveform to be selected according to each bit value, and ensures free setting of the combination between the ejection data and drive waveform pattern data with a simple structure. Further, ink can be ejected also while the non-ejection waveform is applied. This enables application of non-ejection waveform without the recording speed being reduced.

The present embodiment is so programmed that, every time the printer is turned on, the value of the nonvolatile memory (not illustrated) inside the CPU11 is uploaded into the output pattern register 34.

Accordingly, if a rewrite operation is not performed the output pattern register 34 is automatically set to the preset value when the printer is turned on. This arrangement saves operation procedures when output pattern register does not require a rewrite operation.

Wherever required, the output pattern register table can be rewritten by rewriting the value of the nonvolatile memory (not illustrated) in the CPU11.

When a plurality of ink particles are to be ejected from the drive waveform pattern made up of a plurality of the same waveforms in a continuous form, it is also possible to create only the unit waveform using the memory of the drive circuit.

In the present embodiment, the drive signal is inputted from the drive signal generation circuit 15 of the control board 9. It is also possible to create this signal using the memory of the drive circuit.

<Dot Position Adjustment for the Nozzles in a Plurality of Rows in Inkjet Head>

The following describes the dot position adjustment for the nozzles in a plurality of rows in inkjet head in the inkjet printer of FIG. 1 representing the structure characteristic of the present invention:

In the head main body of the present embodiment, in order to ensure that ink particles ejected from the 8-row nozzles reach the predetermined position to produce a straight line image in the sub-scanning direction, it is essential to adjust the timing for ejection of the ink particles coming out of each nozzle row.

To increase the recording speed of the inkjet printer of the present embodiment given in FIG. 1, the present embodiment is provided with a mode of forming dots in both the outward and homeward scanning in the main scanning direction. To ensure excellent image printing in this inkjet printer, it is necessary to align the positions, in the main scanning direction, a dot formed in the outward movement and that formed in the homeward movement. If a relative displacement occurs between the dot formed in the outward movement and that formed in the homeward movement, roughness will occur to the image and the image quality will be reduced.

In bi-directional recording, a slight displacement in the formed dots tends to have a serious impact on image quality. For example, if the recording head moves from left to right for main scanning and the dot tends to be displaced to the left, then on the homeward path the main scanning is carried out in the reverse direction, and the dots tend to be displaced to the right. As a result, displacement having occurred on either the outward or homeward path will double in the case of bi-directional recording. Thus, in the bi-directional recording, a serious deterioration of image quality is caused by misalignment of the dot positions between outward and homeward paths. An easy, high-precision adjustment method must be adopted to adjust dot formation timing.

To correct such displacement in the inkjet printer of the present embodiment, therefore, the following so-called test pattern is used for adjustment:

In the test pattern, dots are formed from each nozzle row by the outward movement. Timings for ejecting ink from the nozzle rows other than the reference nozzle rows to each pixel are displaced by several steps, and the relative positions are varied, whereby dots are formed. The same procedure applies to the case of homeward movement.

For the nozzle row used as a reference, dots are formed from the nozzle row by the outward movement. Without sub-scanning, dots are formed by the homeward movement. In this case, in the homeward movement, timings for ejecting ink to each pixel are displaced by several steps, and the relative positions of the dots between the outward movement and homeward movement are varied, whereby dots are formed.

The optimum timing is selected by observing the test pattern printed in the aforementioned procedure. This allows ejection timing to be adjusted in such a way that dots between the outward and homeward movements from each nozzle row are not displaced.

In the inkjet printer of the present invention, the timing for each pixel is adjusted by displacing the image data inside the page memory 12. Adjustment at a pitch finer than the pixel pitch is made by independently setting the timing for ejecting the ink particles from the nozzle, using the aforementioned the first latch circuit 32A and the second latch circuit 32B.

In the first place, the following describes the former case:

The nonvolatile memory (not illustrated) of the CPU11 in FIG. 4 incorporates the displacement data (amount of shift from the reference position in units of pixel for each nozzle row measured at the time of manufacturing the inkjet printer, wherein this displacement data is stored for each of the outward and homeward directions in the main scanning direction X.

For example, when the inkjet printer is turned on, the displacement data is read out from the CPU11 and, the image data for not allowing any ink to be ejected in the amount corresponding thereto, namely, the zero value data (hereinafter referred to as "correction data") is stored in the page memory 12 given in FIG. 4. The zero value can be represented as (0, 0, 0) in terms of 3-bits.

In this case, the Y-color first nozzle row is located at the position corresponding to the leading position in the outward movement in the main scanning direction, namely, at the preceding reference position. Accordingly, the correction data need not be added to the preceding position (the position preceding the image data in the outward direction). For the second nozzle row of the Y color or the nozzle rows of other colors, correction data having a length proportionate to the nozzle displacement is added before the image data. By contrast, the succeeding data added at the position succeeding the image data for the nozzle rows other than the K-color second nozzle row (the position succeeding the image data in the outward direction). The K-color second nozzle row is located at the succeeding reference position when the carriage has been fed to the rightmost position, so the succeeding data need not added. Similarly to the case of correction data, the succeeding data is made of a zero value. However, it does not require a strict correspondence with the amount of displacement. It is used to ensure a constant data length. Thus, composite image data in the outward direction for driving the nozzle is formed according to the procedure mentioned above.

The following describes how to create composite image data in the homeward direction: The K-color second nozzle row is located at the position corresponding to the leading position in the homeward movement in the main scanning direction, namely, at the succeeding reference position. Accordingly, the correction data need not be added to the preceding position (the position preceding the image data in the homeward direction). For the first nozzle row of the K color or the nozzle rows of other colors, correction data having a length proportionate to the nozzle displacement is added before the image data. By contrast, the succeeding data added at the position succeeding the image data for the nozzle rows other than the Y-color first nozzle row (the position succeeding the image data in the homeward direction). Thus, composite image data in the homeward direction for driving the nozzle is formed.

The image data of each nozzle row formed in this manner is sent to the line memories 13*a* and 13*b* of FIG. 4 for each line, and is inputted into the drive circuits 16Y1 through 16K2 at the same timing for eight nozzle rows, where the image data waits until it is supplied to the piezoelectric device. The carriage 2, namely, the head main body 17 starts to move in the outward direction. When it has been determined from the signal coming from the encoder that that each nozzle row has reached the position for ejection, The CPU11 drives the control circuit 23 and sends the timing signal to each drive circuit 16.

Then each drive circuit 16 sends the composite image data to the piezoelectric device. In this case, since correction data is not added to the composite image data having been outputted for the Y-color first nozzle row, the Y-color first nozzle row starts to eject ink immediately based on the image data, however, other nozzle rows are driven based on the correction data, so the head main body 17 moves in the outward direction, with ink kept without being ejected.

After that, when the head main body 17 has moved in the outward direction from the preceding reference position by the amount of displacement of the Y-color second nozzle row, driving based on correction data terminates. Accordingly, the Y-color second nozzle row starts to eject ink based on image data. Further, when the head 17 has moved in the outward direction from the preceding reference position by the amount of displacement of the M-color first nozzle row, the drive operation based on the correction data terminates and the nozzle row starts ink ejection based on the image data. After that, the head 17 moves in the outward direction by the amount of displacement from the preceding reference position sequentially in the order of the M-color second nozzle row and K-color second nozzle row. Since the drive operation based on correction data terminates, the nozzle starts to eject ink ejection based on the image data.

In the final phase, upon termination of ink ejection from the nozzle row according to the image data of the K-color second nozzle row, the carriage 2 reaches the succeeding reference position. After that, the scanning direction is reversed to the homeward direction. In the homeward direction, nozzle drive control is provided according to the composite image data in a manner similar to the above.

The aforementioned arrangement allows the position of ink arrival to be adjusted in units of pixel pitch for each nozzle row.

Figure 12:
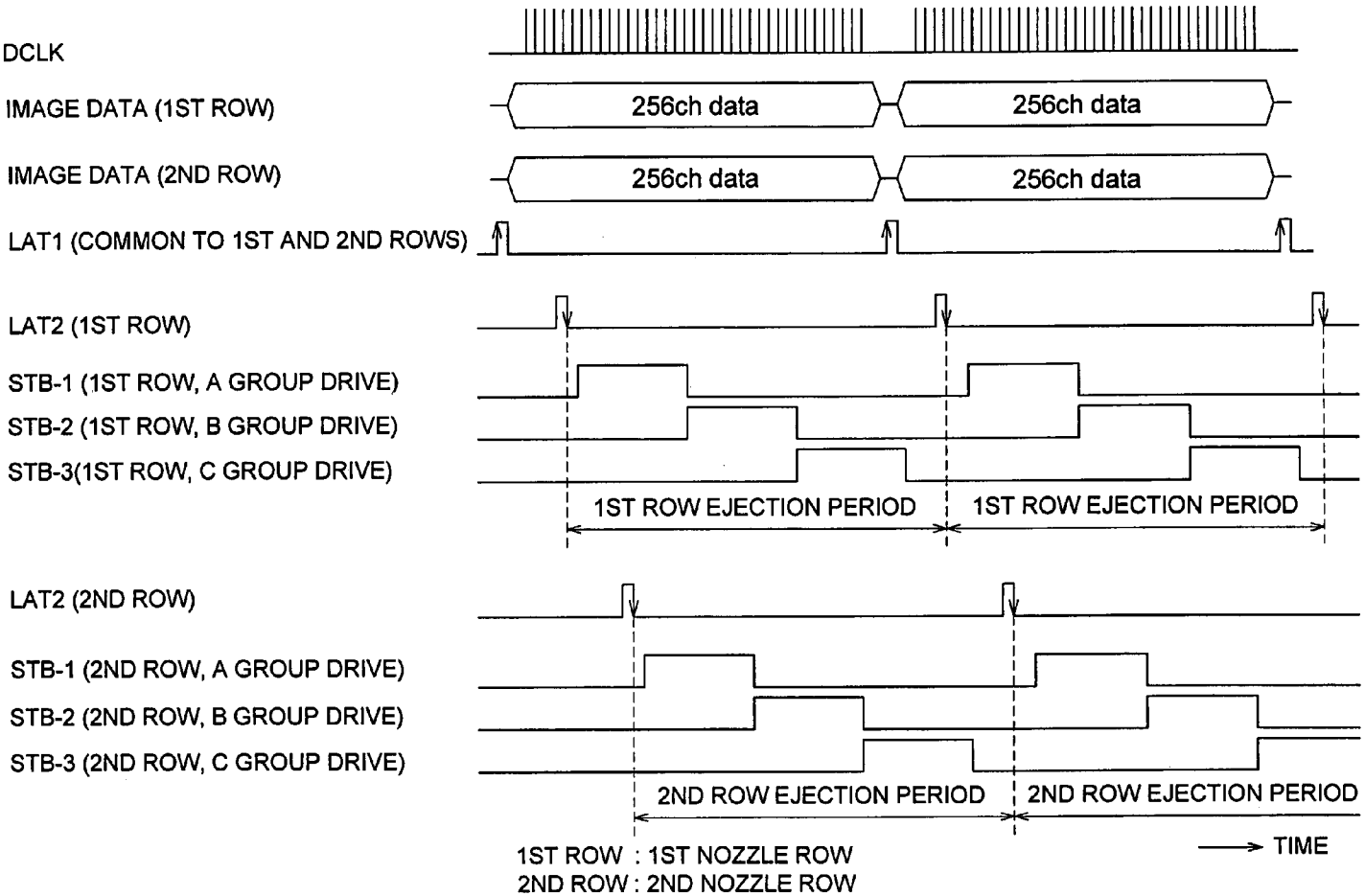
FIG. 12 is a diagram showing an example of the timing for data processing of a plurality of nozzle rows.

The following describes the adjustment to be made at a pitch finer than the pixel pitch: FIG. 12 shows an example of the two-row nozzle row data processing timing chart with reference to the 17Y. The horizontal axis in FIG. 12 represents the time. The same procedure is used for the 17M, 17C and 17K.

In the present embodiment, the yellow (Y) first nozzle row image data is sent to the shift register of the drive circuit 16Y1 from the line memory 13*a* via the 3-bit data signal line based on the transfer clock DCLK. Similarly, the yellow (Y) second nozzle row image data is sent to the shift register of the drive circuit 16Y2 at the same timed intervals. The magenta (M) image data is sent to the shift register of the drive circuits 16M1 and 16M2 from the line memory 13*a*, and the cyan (C)

image data is sent to the shift register of the drive circuits 16C1 and 16C2 from line memory 13*b*. The black (K) image data is sent to the shift register of the drive circuits 16K1 and 16K2 from line memory 13*b*.

As described above, the image data corresponding to the nozzle row is transmitted to the shift register of the drive circuit 16 corresponding to the nozzle row through the control board 9, and is stored therein. The timing for the aforementioned data transmission and storage is controlled in such a way as to ensure synchronization among a plurality of nozzle rows (eight rows in this case) (to set the common timing, namely, the same timing for the purpose of the present embodiment). This allows synchronization of data transmission to the shift registers of a plurality of drive circuits corresponding to a plurality of nozzle rows, and provides effective data transmission trigger processing. This arrangement also simplifies the control section structure.

When the carriage 2 has reached a predetermined position—i.e. data transmission for 256 channels in this case has completed in this case—, the control circuit 23 receives the TRGIN signal as described above, and outputs the LAT1 signal (a rising edge shown by an arrow in the figure) as the first trigger signal for designating the latching time. Upon receipt of this LAT1 signal, the first latch circuit 32A latches the image data outputted in parallel from the register 31. In the present embodiment, the intervals timed to output the LAT1 signal are standardized among the 8-row nozzles. To be more specific, the image data sent to the shift register simultaneously among eight rows are latched by the first latch circuit 32A simultaneously among eight rows.

As described above, when the image data of the shift register is stored into the first latch circuit synchronously among a plurality of nozzle rows, the image data corresponding to the nozzle row can be sent and stored into the shift register of each drive circuit 16 of the corresponding nozzle rows synchronously among a plurality of nozzle rows (eight rows in this case).

The ejection timing displacement data represented at a pitch finer than the pixel pitch among nozzle rows as measured at the time of manufacturing the inkjet printer is stored in the nonvolatile memory (not illustrated) of the CPU11 given in FIG. 4. This data is stored for the outward and homeward movements in main scanning direction X.

For example, when the inkjet printer is turned on, The CPU11 given in FIG. 4 reads the displacement time data from the nonvolatile memory. Based on this displacement time, the control circuit 23 controls the interval timed for outputting the latching timing signal LAT2 (falling edge), independently for each nozzle row, and outputs it to each drive circuit corresponding to the nozzle row.

Upon receipt of the LAT2 signal, the second latch circuit 32B latches the image data outputted in parallel from the first latch circuit 32A. The image data having been latched by the second latch circuit 32B is outputted to a gray scale controller 33 sequentially starting from the nozzle row of group A. Then the pressurization section is driven and ink particles are ejected.

As described above, the image data stored in the first latch circuit is stored in the second latch circuit. The interval timed for this storing is set independently among a plurality of nozzle rows. This arrangement ensures that the interval timed to eject ink particles from each nozzle row can be independently controlled for each of the plurality of nozzle rows, and the position of ink arrival for each nozzle row can be adjusted at a pitch finer than the pixel pitch.

When two latch sections are provided as described above, data can be synchronously sent to the shift registers of a plurality of drive circuits corresponding to a plurality of nozzle rows, without having to overly increase the data transmission speed or to reduce the recording speed. This ensures efficient data transmission trigger processing, and provides a simplified structure of the control section. Further, the interval timed for ejection of ink particles from each nozzle row can be controlled for each of a plurality of nozzle rows, and the position of the arrival of ink particles for each nozzle row can be adjusted at a pitch finer than the pixel pitch.

Figure 13:
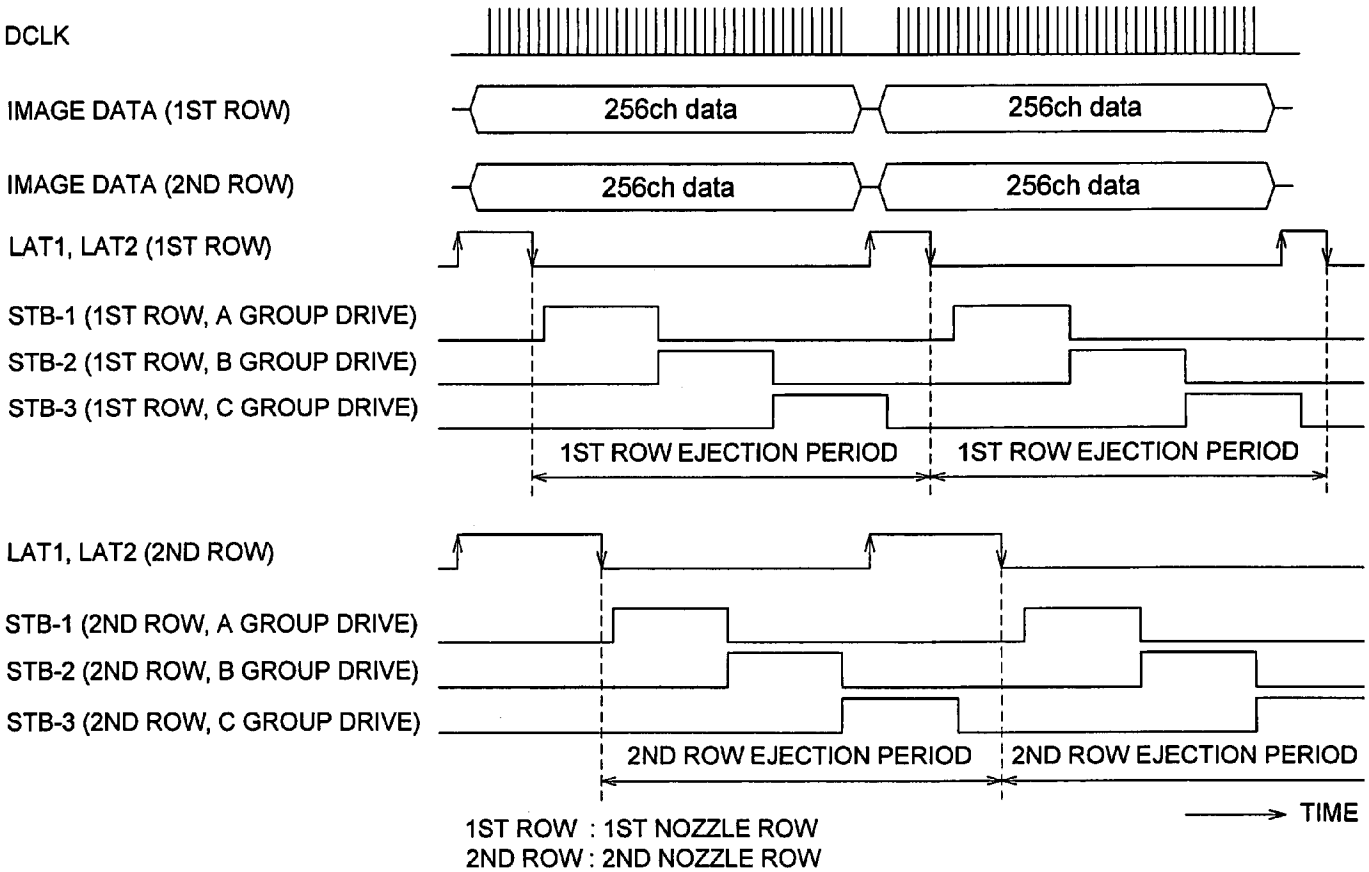
FIG. 13 is a diagram showing a preferable example of the timing for data processing of a plurality of nozzle rows.

FIG. 13 shows a preferred example of the data processing timing chart with reference to two nozzle rows 17Y. The horizontal axis in FIG. 12 represents the time. The same procedure is used for the 17M, 17C and 17K.

In this example, the first trigger signal LAT1 (rising edge) and the second trigger signal LAT2 (falling edge) for each row are the standardized trigger signals made up of pulse signals each having a rising edge and a falling edge. This provides a simple structure and produces trigger signals standardized for latching timing. It also reduces the number of the latching timing trigger input signal lines. Further, easy change of two intervals timed for latching can be achieved by changing the pulse width.

The aforementioned pulse signal can be assumed as a downward pulse, the falling edge as the LAT1 signal and the rising edge as the LAT2 signal.

<Line Type Inkjet Printer>

Figure 14:
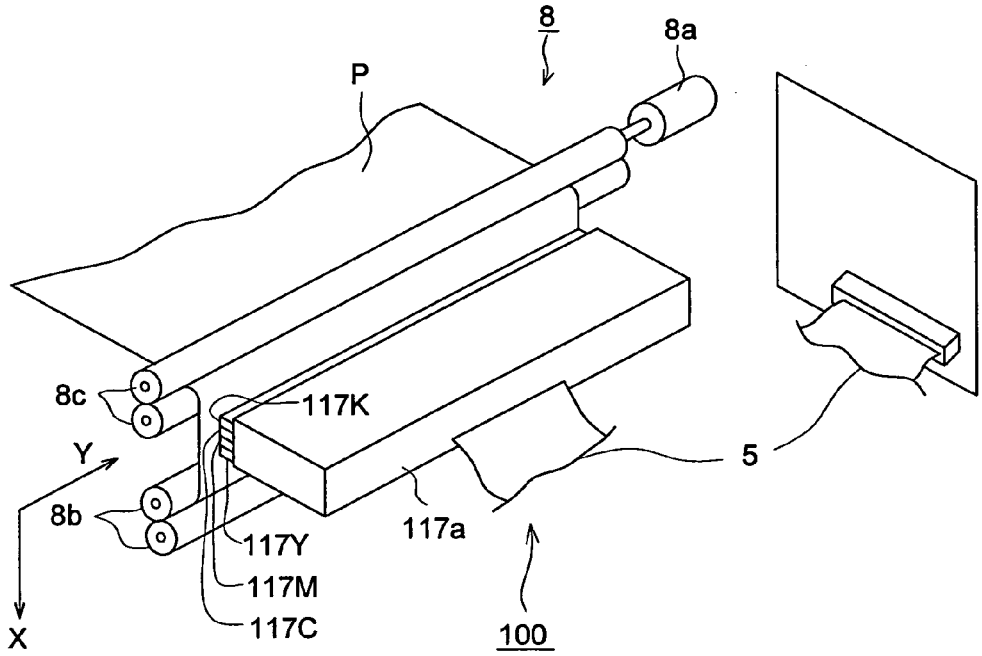
FIG. 14 is a perspective view representing the major components of the line type inkjet printer.

FIG. 14 is a perspective view representing the major components in an example where the present invention is applied to the inkjet printer 100 equipped with the line head main body. In FIG. 14, the same reference numerals are assigned to the devices and members if they are the same as those of the aforementioned serial head.

The four head main bodies 17 having 512 nozzles for each color given in FIG. 1 (512×4 nozzles for each color) arranged in the sub-scanning direction Y are incorporated in the outer case 117*a*, wherein the color heads are placed on top of another in the main scanning direction X in the order of 117Y, 117M, 117C and 117K. Similarly, ink particle ejection operation is controlled by the drive circuit 16 of the present invention incorporated also in the outer casing 117*a*.

Similarly to the case of the inkjet printer 1, the sheet conveyance mechanism 8 allows the recording paper P to be conveyed in the main scanning direction X by the conveyance motor 8*a*, conveyance roller pair 8*b* and conveyance roller pair 8*c*. Otherwise, its structure is the same as that of the inkjet printer 1, except that basic configuration such as the control board 9 and drive circuit 16 formed into ICs are modified to conform to 512×4 nozzles.

Similarly to the case of the inkjet printer 1, the inkjet printer 100 ensures that image data having been sent from the personal computer is sent to the line memories 13*a* and 13*b*. The image data represented in terms of gradation of three bits per pixel is sent from the line memories 13*a* and 13*b* to the drive circuit 16 connected by the flexible cable 5. When the trigger-in signal TRGIN has been inputted, the drive circuit 16 allows ink to be ejected from the nozzle head 17, similarly to the case of the drive circuit 16 of the inkjet printer 1, and the image is recorded on the recording paper P.

As described above, in the aforementioned embodiment, a square wave drive waveform having a rise time and fall time sufficiently shorter than those of the AL is applied to the piezoelectric device. Use of the square wave provides a driving operation making more effective use of the pressure wave acoustic resonance. When compared with the method of using a trapezoidal wave, this method ensures higher ink particle ejection efficiency so that driving operation can be performed at a lower drive voltage. Further, a simplified digital circuit can be designed. Such advantages are provided by this arrangement. A further advantage is easy setting of the pulse width.

The pressurization section in the aforementioned embodiment utilizes a shear mode type piezoelectric device subjected to deformation in the shear mode upon application of electric field. The shear mode type piezoelectric device allows more effective use of the square wave drive pulse and a reduction of the drive voltage. This arrangement provides more efficient driving, and is preferably used. Further, an example has been taken from the head provided with a continuation of the ink channels as pressure generation chambers separated by a partition. The present invention is also applicable to the dummy channel type head wherein the ink channels and dummy channels are arranged alternately so that ink is ejected from ink channels arranged alternately. In this case, even if the ink channel partition is subjected to shear deformation, other adjacent ink channels are not affected. Easy driving of the ink channel is provided.

It should be noted, however, that the present invention is not restricted thereto. For example, another form of piezoelectric device such as a single substrate type piezoelectric actuator or a longitudinal vibration type lamination piezoelectric device can be used as a piezoelectric device. It is also possible to utilize another pressurization device such as an electromechanical conversion device based on electrostatic power or magnetic force or an electro-thermal conversion device for applying pressure based on boiling method.

In the above description, an example of an inkjet printer has been used as a liquid droplet ejecting apparatus, and an inkjet recording head for image recording is used as an liquid droplet ejecting head. However, the present invention is not restricted thereto. The present invention can be widely used as a liquid droplet ejecting head or a liquid droplet ejecting apparatus for allowing the liquid in the pressure generation chamber to be ejected as liquid droplets from the nozzle, wherein the liquid droplet ejecting head or liquid droplet ejecting apparatus incorporates: a plurality of nozzle rows for ejecting liquid droplets; a pressure generation chamber communicating with the nozzles constituting the aforementioned nozzle rows; a liquid droplet head main body provided with a pressurization section, driven based on the ejection data, for giving pressure to the pressure generation chamber so that liquid droplets are ejected from nozzles; and a plurality of drive circuits corresponding to the aforementioned plurality of nozzle rows. For example, this invention can be effectively used in the industrial field, for example, for manufacturing a liquid crystal color filter. This method is especially effective when liquid droplets are ejected from a plurality of nozzle rows.

EFFECTS OF THE INVENTION

The present invention permits synchronous data transmission to the first storage section of a plurality of drive circuits corresponding to a plurality of nozzle rows, without having to overly increase the data transmission speed or to reduce the recording speed. This ensures efficient data transmission trigger processing, and provides a simplified structure of the control system. Further, the position of the arrival of liquid droplets for each nozzle row can be adjusted at a pitch finer than the pixel pitch.

The present invention reduces the number of the latching timing trigger input signal lines.

The present invention provides a simple structure and produces trigger signals standardized for latching timing. Further, easy change of two intervals timed for latching can be achieved by changing the pulse width.

The present invention allows nozzle rows to be machined to a high precision, and permits easy adjustment of the position of arrival of the liquid droplet for each nozzle row.

The present invention provides recording at a resolution higher than that for one-row nozzles. In this case, the present invention permits high-precision adjustment of the position of arrival for the nozzles of a plurality of rows. This improves the linearity of the line image formed by liquid droplets ejected from the nozzles of a plurality of rows.

The present invention permits synchronous data transmission to the first storage section of a plurality of drive circuits corresponding to a plurality of nozzle rows, without having to overly increase the data transmission speed or to reduce the recording speed. This ensures efficient data transmission trigger processing, and provides a simplified structure of the control system. Further, the position of the arrival of liquid droplets for each nozzle row can be adjusted at a pitch finer than the pixel pitch.

What is claimed is:

1. An apparatus for ejecting liquid droplets onto a recording medium, comprising:

a liquid droplet ejecting head main body which includes:

a plurality of nozzle rows for ejecting the liquid droplets;

a pressure generation chamber communicating with a nozzle in the plurality of nozzle rows;

a pressurization section, driven based on ejecting data, for giving pressure to the pressure generation chamber so that the liquid droplets are ejected from nozzles; and a plurality of drive circuits corresponding to the plurality of nozzle rows, each of the plurality of drive circuits comprising:

a first storage section for storing the ejection data corresponding to a nozzle row in the plurality of nozzle rows;

a first latch section for storing the ejection data outputted from the first storage section;

a second latch section for storing the ejection data outputted from the first latch section; and a drive section for driving the pressurization section based on the ejection data stored the second latch section; and a control section, wherein the control section ensures that a timing for storing the ejecting data outputted from the first storage section into the first latch section is synchronized among the plurality of nozzle rows, and a timing for storing the ejecting data outputted from the first latch section into the second latch section is capable to be adjusted independently among a plurality of nozzle rows.

2. The apparatus of claim 1, wherein in each of the plurality of drive circuits, a first trigger signal for specifying the timing for storing the ejection data outputted from the first storage section into the first latch section, and a second trigger signal for specifying the timing for storing the ejection data outputted from the first latch section into the second latch section are a common trigger signal.

3. The apparatus of claim 2, wherein the common trigger signal is a pulse signal having two edges of a rising edge and a falling edge, wherein a first edge of the two edges is the first trigger signal and a second edge of the two edges is the second trigger signal.

4. The apparatus of claim 3, wherein plural nozzle rows for ejecting same color liquid droplets in the plurality of nozzle rows are formed in one nozzle plate.

5. The apparatus of claim 4, wherein the plural nozzle rows for ejecting same color liquid droplets are arranged in a main scanning direction for the recording medium, and nozzles of each row in the plural nozzle rows are arranged in displaced positions from nozzles of another row so as to interpolate one another, in such a way that a predetermined line is formed on the recording medium by the liquid droplets of same color ejected from the nozzles of each row in the plural nozzle rows.

6. The apparatus of claim 2, wherein plural nozzle rows for ejecting same color liquid droplets in the plurality of nozzle rows are formed in one nozzle plate.

7. The apparatus of claim 6, wherein the plural nozzle rows for ejecting same color liquid droplets are arranged in a main scanning direction for the recording medium, and nozzles of each row in the plural nozzle rows are arranged in displaced positions from nozzles of another row so as to interpolate one another, in such a way that a predetermined line is formed on the recording medium by the liquid droplets of same color ejected from the nozzles of each row in the plural nozzle rows.

8. The apparatus of claim 1, wherein plural nozzle rows for ejecting same color liquid droplets in the plurality of nozzle rows are formed in one nozzle plate.

9. The apparatus of claim 8, wherein the plural nozzle rows for ejecting same color liquid droplets are arranged in a main scanning direction for the recording medium, and nozzles of each row in the plural nozzle rows are arranged in displaced positions from nozzles of another row so as to interpolate one another, in such a way that a predetermined line is formed on the recording medium by the liquid droplets of same color ejected from the nozzles of each row in the plural nozzle rows.

10. A method for ejecting liquid droplets from nozzles onto a recording medium with using: a liquid droplet ejecting head main body which including a plurality of nozzle rows for ejecting liquid droplets, a pressure generation chamber communicating with a nozzle in the plurality of nozzle rows, and a pressurization section, driven based on ejecting data, for giving pressure to the pressure generation chamber so that liquid droplets are ejected from the nozzles; and a plurality of drive circuits corresponding to the plurality of nozzle rows, the method comprising:

storing the ejection data, corresponding to the plurality of nozzle rows stored in a first storage section of the plurality of drive circuits, into a first latch section at a timing for synchronizing among the plurality of nozzle rows;

storing the ejection data stored in the first latch section into a second latch section at a timing independently set among the plurality of nozzle rows; and ejecting liquid droplets from the plurality of nozzle rows by driving the pressurization section at the timing independently set among a plurality of nozzle rows, based on the ejection data stored in the second latch section.

11. The method of claim 10, wherein in each of the plurality of drive circuits, a first trigger signal for specifying the timing for storing the ejection data outputted from the first storage section into the first latch section, and a second trigger signal for specifying the timing for storing the ejection data outputted from the first latch section into the second latch section are a common trigger signal.

12. The method of claim 11, wherein the common trigger signal is a pulse signal having two edges of a rising edge and a falling edge, wherein a first edge of the two edges is the first trigger signal and a second edge of the two edges is the second trigger signal.

13. The method of claim 10, wherein plural nozzle rows for ejecting same color liquid droplets in the plurality of nozzle rows are formed in one nozzle plate.

14. The apparatus of claim 13, wherein the plural nozzle rows for ejecting same color liquid droplets are arranged in a main scanning direction for the recording medium, and nozzles of each row in the plural nozzle rows are arranged in displaced positions from nozzles of another row so as to interpolate one another, in such a way that a predetermined line is formed on the recording medium by the liquid droplets of same color ejected from the nozzles of each row in the plural nozzle rows.

* * * * *